US010113375B2

(12) United States Patent
Kunec

(10) Patent No.: US 10,113,375 B2
(45) Date of Patent: Oct. 30, 2018

(54) THREAD COMPENSATION APPARATUS

(71) Applicant: Canrig Drilling Technology LTD., Houston, TX (US)

(72) Inventor: Alex Kunec, Tomball, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 916 days.

(21) Appl. No.: 14/540,941

(22) Filed: Nov. 13, 2014

(65) Prior Publication Data

US 2016/0138348 A1 May 19, 2016

(51) Int. Cl.

| | |
|---|---|
| ***E21B 19/16*** | (2006.01) |
| ***E21B 19/06*** | (2006.01) |
| ***E21B 19/00*** | (2006.01) |
| ***E21B 3/00*** | (2006.01) |
| ***E21B 3/02*** | (2006.01) |

(52) U.S. Cl.

CPC ..... *E21B 19/16* (2013.01); *E21B 3/00* (2013.01); *E21B 3/02* (2013.01); *E21B 19/00* (2013.01); *E21B 19/06* (2013.01); *E21B 19/161* (2013.01); *E21B 19/163* (2013.01); *E21B 19/165* (2013.01)

(58) Field of Classification Search

CPC ... E21B 3/00; E21B 3/02; E21B 19/00; E21B 19/16; E21B 19/161; E21B 19/163; E21B 19/165

See application file for complete search history.

(56) References Cited

U.S. PATENT DOCUMENTS

| | | | | |
|---|---|---|---|---|
| 5,645,131 | A * | 7/1997 | Trevisani | E21B 19/02 166/77.52 |
| 8,240,371 | B2 | 8/2012 | Tepavac et al. | |
| 8,365,834 | B2 | 2/2013 | Liess et al. | |
| 2014/0090856 | A1* | 4/2014 | Pratt | E21B 19/06 166/380 |
| 2015/0027732 | A1* | 1/2015 | Wood | E21B 19/08 166/380 |
| 2015/0184473 | A1* | 7/2015 | Wright | E21B 19/155 166/379 |

* cited by examiner

*Primary Examiner* — D. Andrews
*Assistant Examiner* — Tara E Schimpf

(57) ABSTRACT

A thread compensation apparatus including a drive connection. The drive connection portion includes an outer portion coupled to a drive apparatus and a rotating inner portion with a drive interface configured to couple to a rotating shaft of the drive apparatus. The thread compensation apparatus also includes a sleeve being rotatable with the inner portion of the drive connection, the sleeve being rotatable relative to the outer portion of the drive connection. The thread compensation apparatus includes a lower shaft which engages the sleeve, such that the sleeve can impart rotation to the lower shaft. Additionally, the lower shaft also includes a lower connection interface, such as to couple to a tubular gripping apparatus. Further, the lower shaft is displaceable relative to the sleeve and an actuator coupled to the outer portion of the drive connection operates to displace the lower shaft with respect to the sleeve.

41 Claims, 18 Drawing Sheets

THREAD COMPENSATION APPARATUS

BACKGROUND

The present invention relates generally to drilling for, and the extraction of, natural resources contained within the earth. Such natural resources can include, but are not limited to, natural gas, crude oil, other hydrocarbons, water, or any number of liquid or gaseous natural resources which are extracted via drilling processes. In particular the present invention relates to the drilling of a well and the subsequent insertion of tubulars to form a casing or casings along the length of the well. It should be appreciated that increasing the speed at which such wells can be drilled and provided with casings increases the speed at which the natural resources can be accessed and withdrawn, thus improving production efficiencies and lowering production costs. Development of improved systems that accomplish such drilling and that facilitate efficient assembly of tubulars is a continuing endeavor.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention, they are therefore not to be considered limiting of its scope. It will be readily appreciated that the components of the present invention, as generally described and illustrated in the figures herein, can be arranged and designed in a wide variety of different configurations. Nonetheless, the invention will be described and explained with additional specificity and detail through the use of the accompanying drawings in which:

DETAILED DESCRIPTION

Figure 1A:
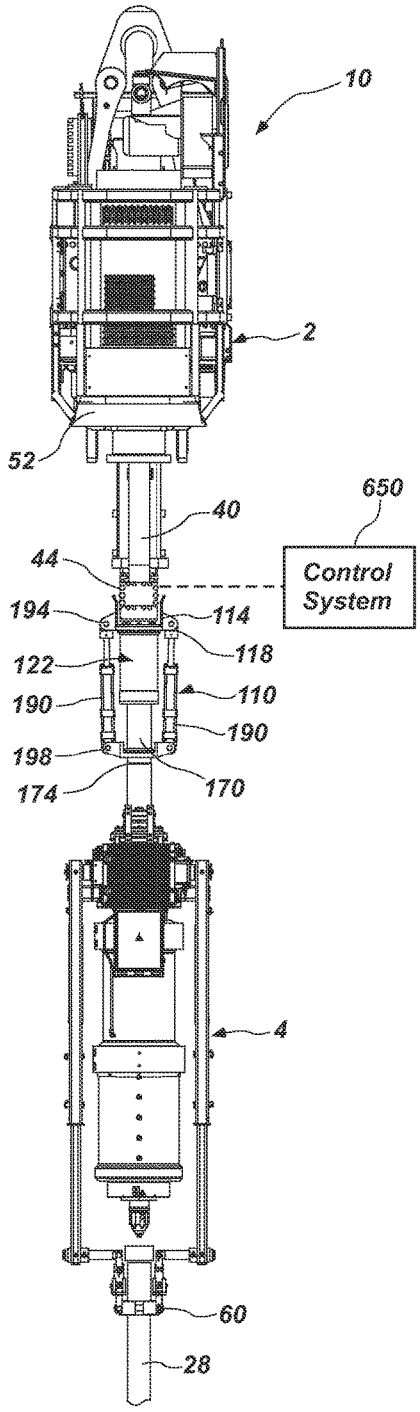
FIGS. 1 A-B illustrate front and isometric views, respectively, of an exemplary embodiment of a tubular threading system in accordance with one aspect of the present invention.
Figure 1B:
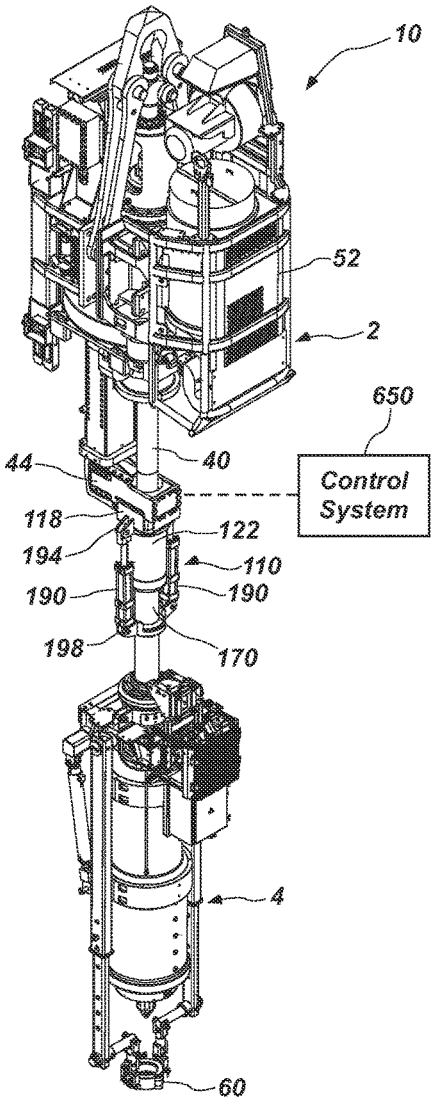
Figure 2:
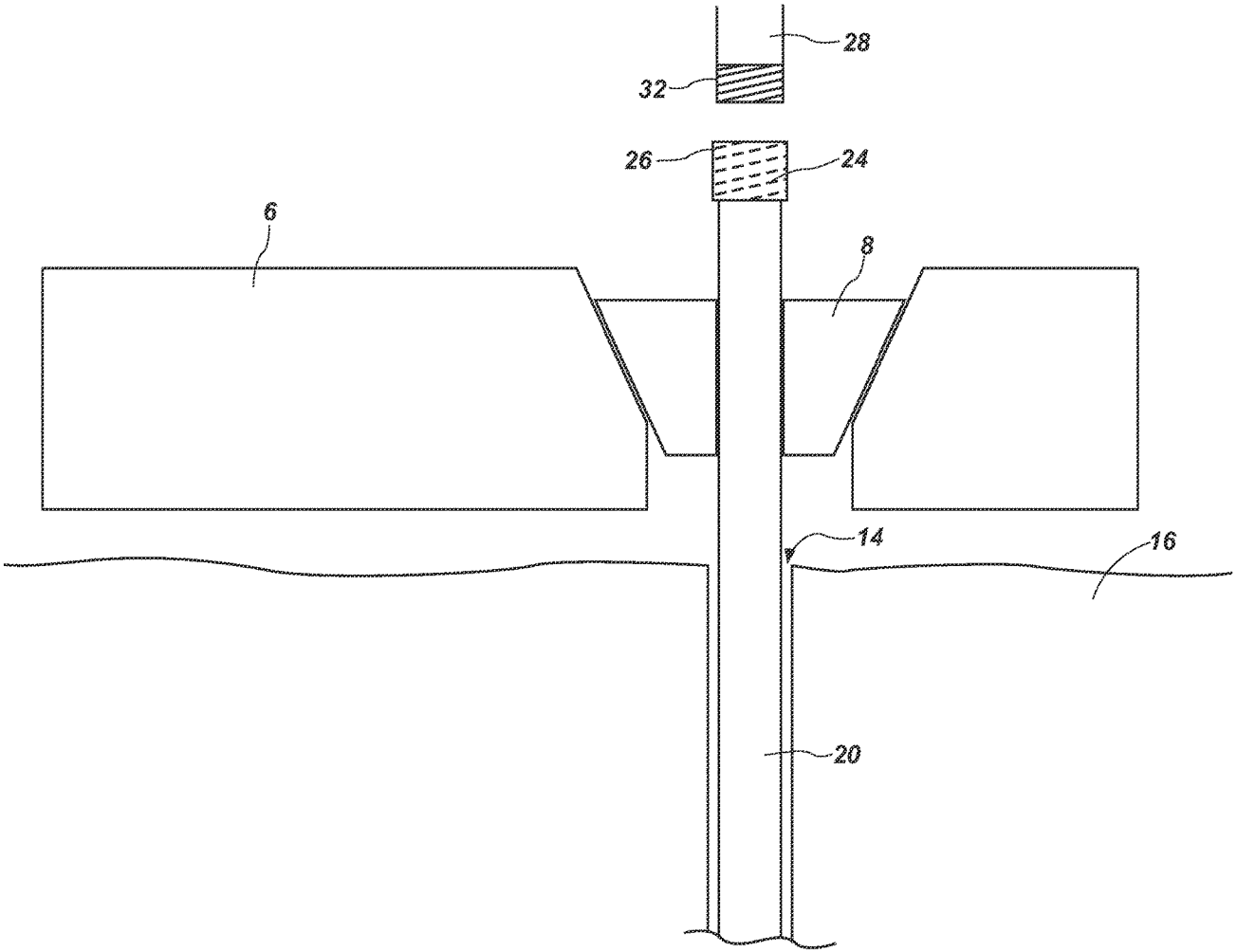
FIG. 2 illustrates a graphical representation of an exemplary drilling platform having a tubular retention system which holds a string of tubulars in a drilled well.
Figure 3A:
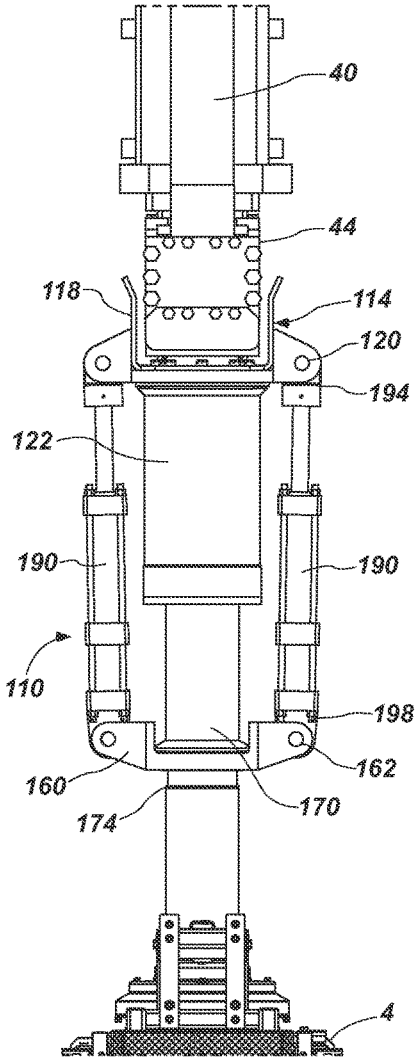
FIGS. 3 A-B illustrate front and isometric views, respectively, of a more detailed view of a thread compensation apparatus in accordance with one aspect of the present invention.
Figure 3B:
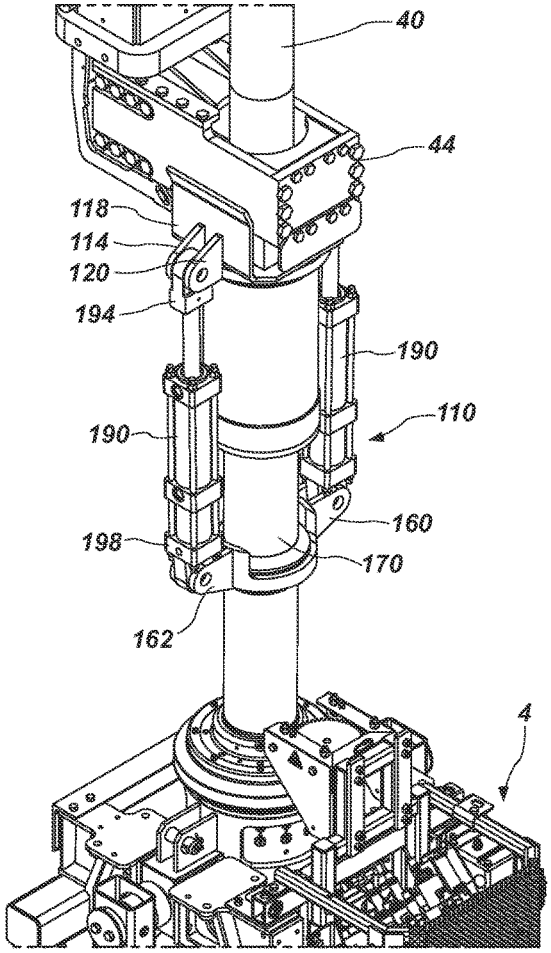
Figure 4A:
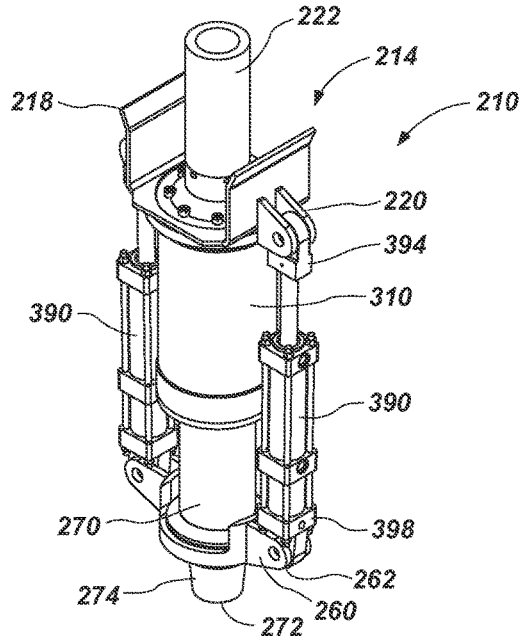
FIGS. 4 A-C illustrate various views of an exemplary thread compensation apparatus in accordance with the present invention.
Figure 4B:
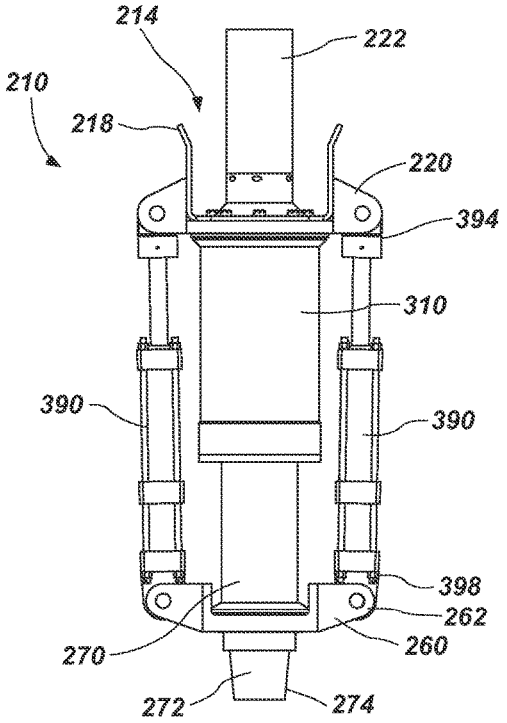
Figure 4C:
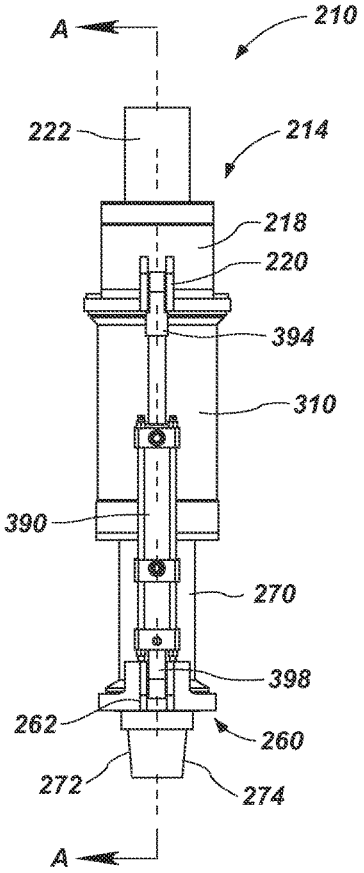
Figure 5:
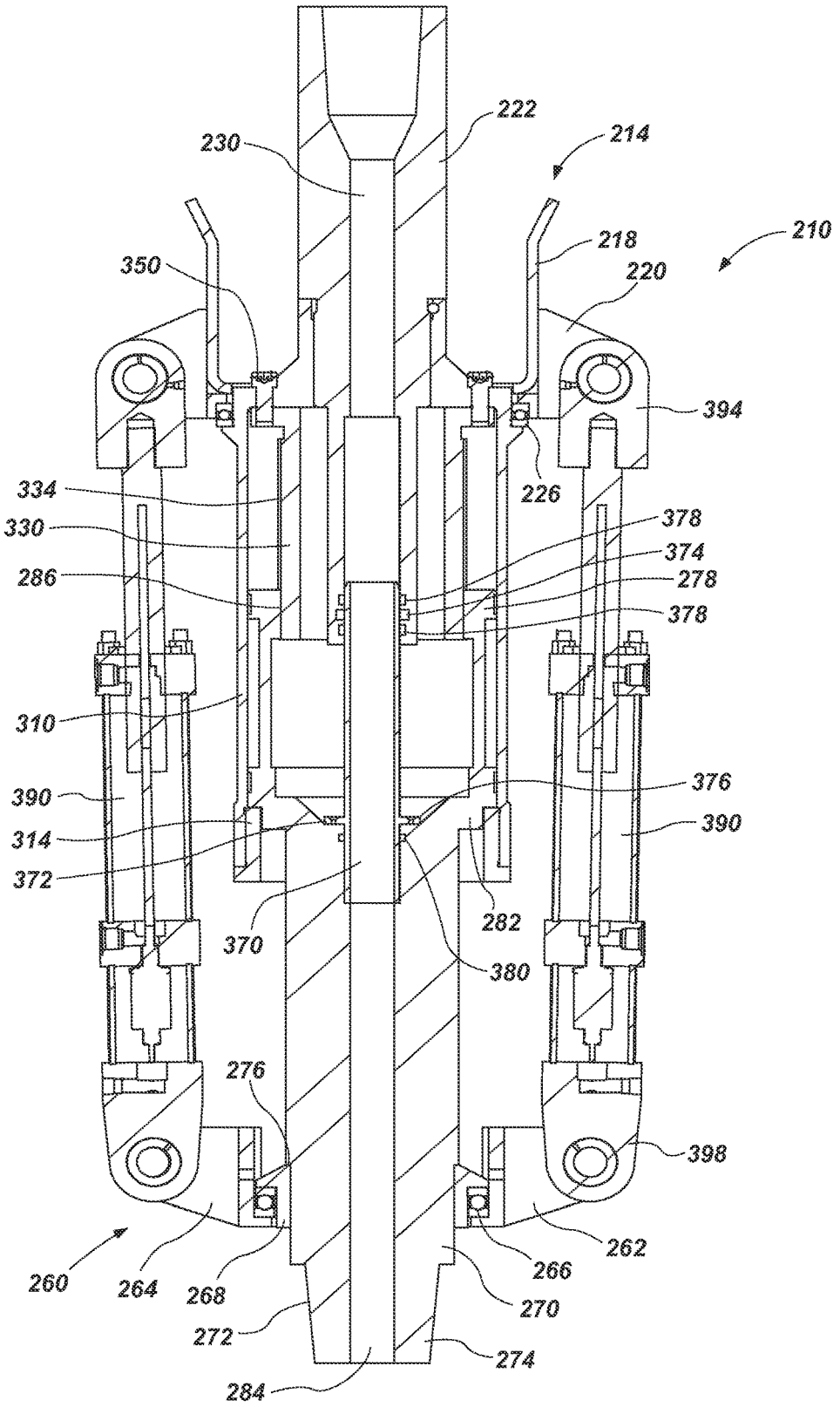
FIG. 5 illustrates a front sectional view of the thread compensation apparatus of FIGS. 4 A-C, as taken along the line A-A of FIG. 4C, and as shown in an extended configuration.
Figure 6:
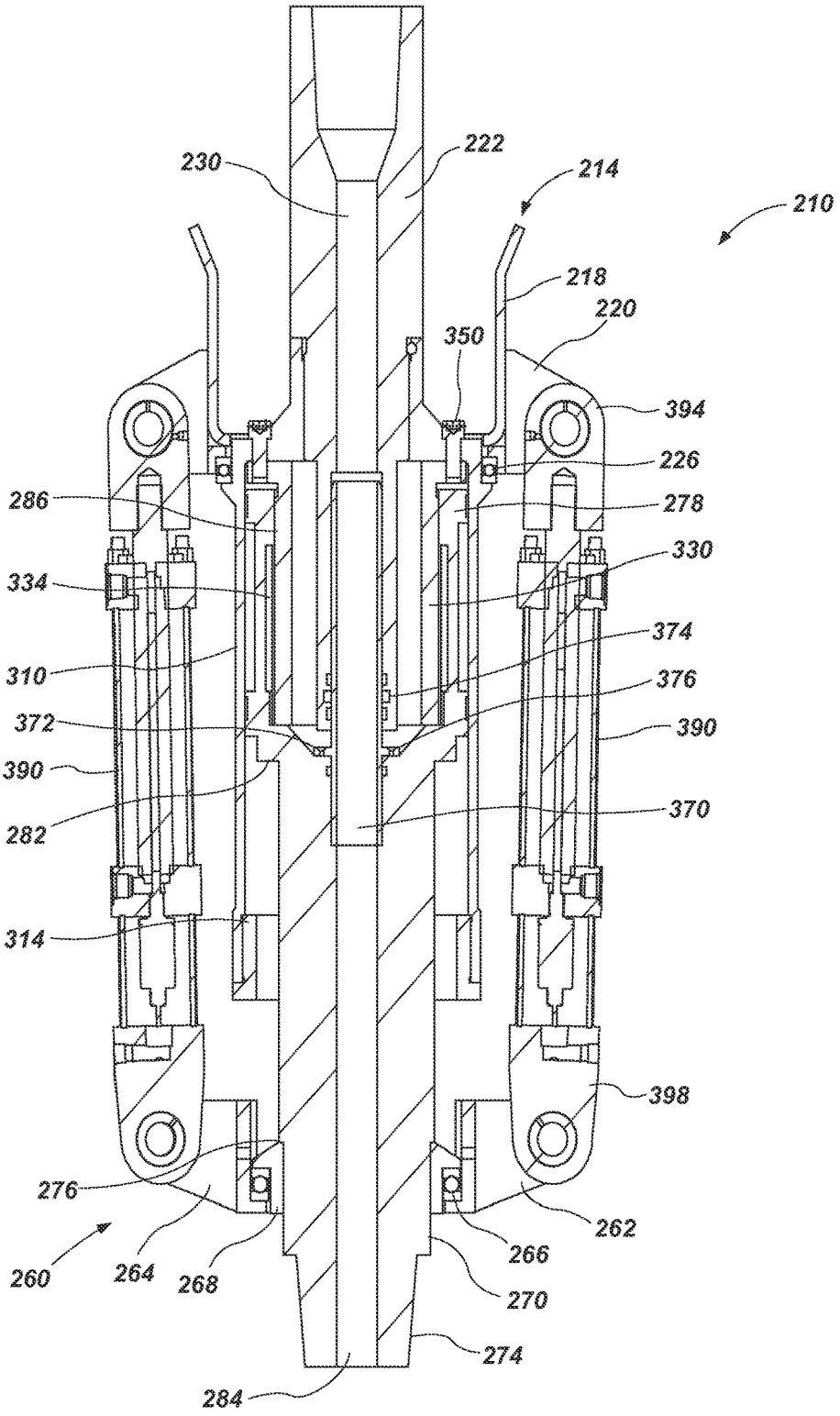
FIG. 6 illustrates a front sectional view of the thread compensation apparatus of FIGS. 4 A-C, as taken along the line A-A of FIG. 4C, and as shown in a retracted configuration.
Figure 7A:
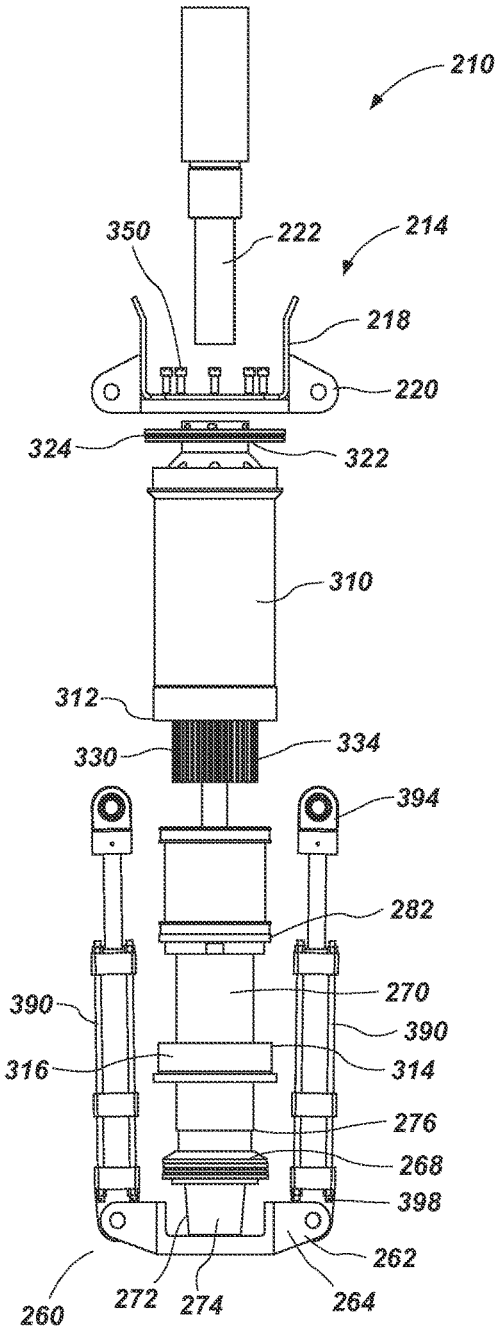
FIGS. 7A-B illustrate front and side exploded views, respectively, of the thread compensation apparatus of FIGS. 4 A-C.
Figure 7B:
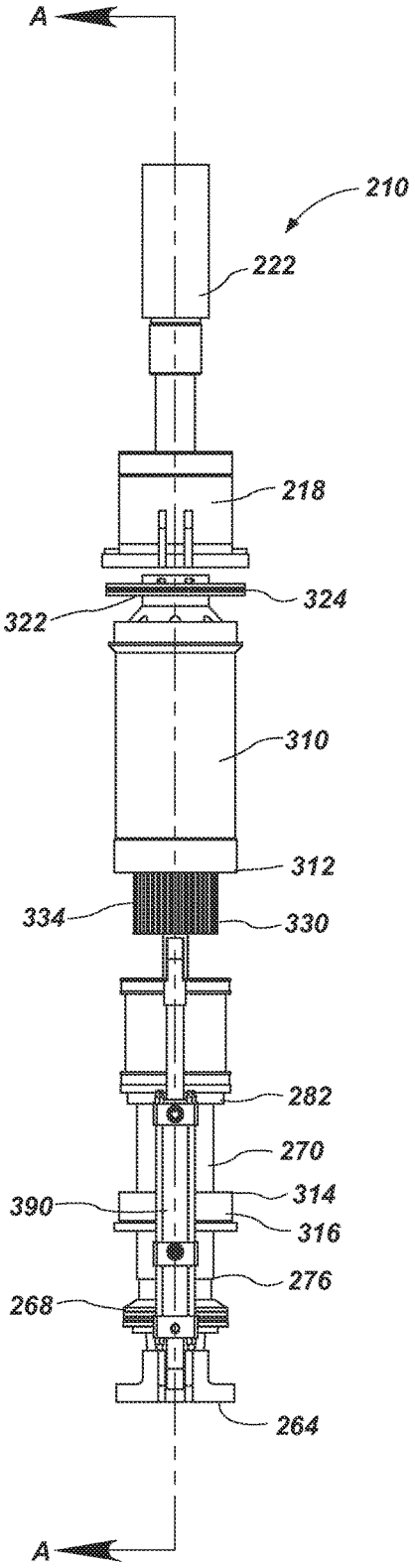
Figure 8:
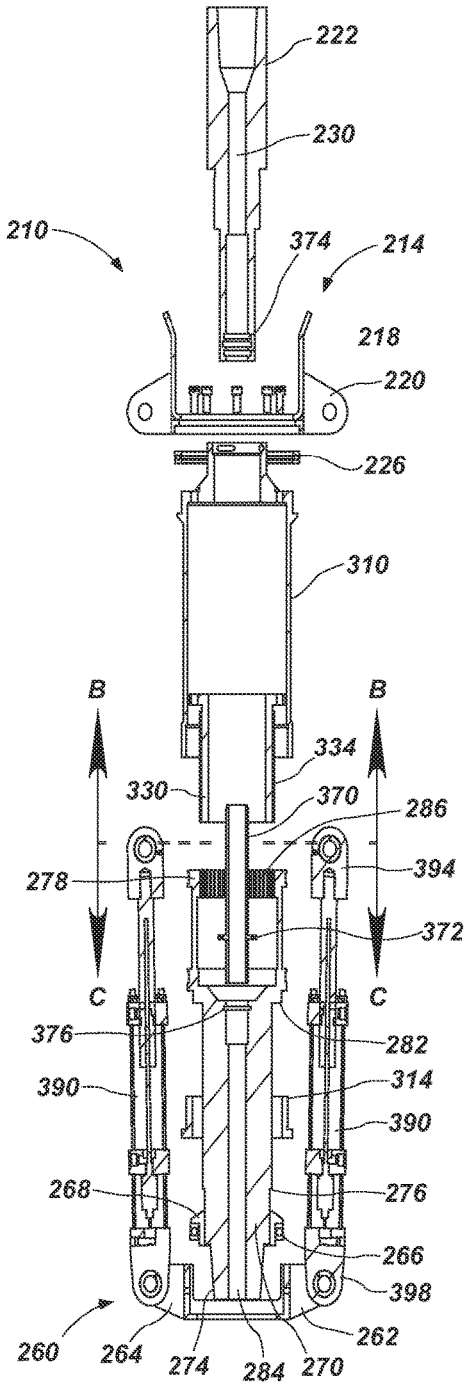
FIG. 8 illustrates a front exploded view of the thread compensation apparatus of FIGS. 4 A-C, as taken along the line A-A of FIG. 7B.
Figure 9B:
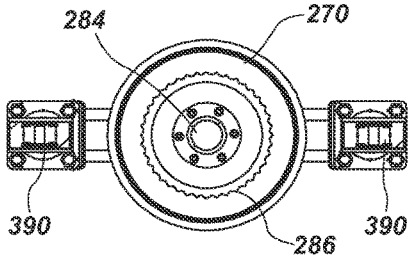
FIGS. 9 A-B illustrates sectional top and bottom views, respectively, of the thread compensation apparatus of FIGS. 4 A-C, as taken along the lines B-B and C-C respectively.
Figure 9A:
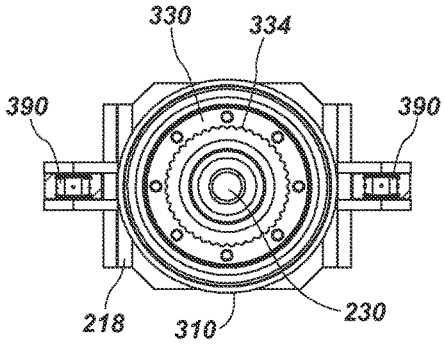

The following detailed description of exemplary embodiments of the invention makes reference to the accompanying drawings, which form a part hereof and in which are shown, by way of illustration, exemplary embodiments in which the invention can be practiced. While these exemplary embodiments are described in sufficient detail to enable those skilled in the art practice the invention, it should be understood that other embodiments can be realized and that various changes to the invention can be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

As discussed briefly above, the present invention relates generally to drilling for, and the extraction of, natural resources contained within the earth. In order to obtain such natural resources, a well can be drilled using a drilling rig, the drilling rig having a drive apparatus (e.g., top drive), which cuts a well with a drive shaft and associated drill bit. After the well is cut, it is typical to provide casing to prevent the collapse of the well. Such casing prevents the collapse of the well walls, and also prevents debris or other contaminants from entering into the stream of natural resources during extraction. The annular casing can be provided by connecting a series of tubulars (e.g., pipes) and lowering the tubulars into the well. Such tubulars can vary greatly in length and diameter. For example, tubulars can comprise dimensions anywhere from 20-50 feet long and 4-36 inches in diameter.

The process for inserting the tubulars into the well typically involves lowering a string of tubulars into the well, such that only a small portion of the top tubular in the string of tubulars is exposed above the surface on the platform. Some sort of locking or holding device can be provided on the string of tubulars which prevents the string of tubulars from falling into the well. In order to extend the length of the string of tubulars, new or additional tubulars, herein referred to as an extending tubulars, can be threaded or otherwise connected to the top of the exposed tubular, thus incrementally lengthening the tubular string. The tubular string is repeatedly lowered into the well, with additional extending tubulars incrementally attached, wherein the process is repeated until the string of tubulars reaches a desired length.

The locking or holding device, which holds the string of tubulars while the extending tubular is being attached, can be provided in a variety of forms, shown herein, the locking or holding device is depicted as a plurality of floor slips comprised of wedge shaped pieces that are wedged between the string of tubulars and the drilling platform floor and utilize friction to prevent the string of tubulars from falling into the well. It will be appreciated that the specific type of locking or holding mechanism is shown for exemplary purposes, and that other types of designs are contemplated herein for use with the systems and devices taught herein.

After the extending tubular is connected, the string of tubulars is lifted so that the locking or holding device can be disengaged and the new string of tubulars, including the recently installed extending tubular, is then lowered so that only a small portion of the top tubular, i.e. the recently installed extending tubular, is exposed above the surface of the platform. The locking or holding device can then be reengaged, and a new extending tubular can be attached. This process can be repeated as often as needed until the string of tubulars reaches a desired length within the well.

It has been recognized that threaded tubulars, i.e. tubulars which connect one to another by utilizing male and female threaded ends, have provided particularly good casings which are substantially sealed, and able to support the weight of the string of tubulars as the string gets exceedingly long.

At least one of the reasons for using threaded tubulars includes the fact that the extending tubulars used in these applications are too long and heavy to be handled manually, and typically, the machinery for providing rotation to an extending tubular so as to thread the extending tubular into the exposed top tubular is already present on the platform, such machinery being the same drive apparatus that rotates the drill bit, i.e. the top drive.

However, using the drive apparatus to impart rotation to an extending tubular has presented other challenges. One such challenge includes the fact that the drive apparatus is capable of applying an extremely large torque, which torque can often cause stresses which exceed the strength of the threads between the extending tubular and the exposed top tubular of the string of tubulars. Over tightening in this manner can result in stripping of the threads, thus often requiring replacement of both the extending tubular and the top tubular of the string of tubulars.

Further, while the drive apparatus often has a threaded connection which would allow for connection of the drive apparatus directly to the extending tubular via the upper threads of the extending tubular, the possibility of cross threading, and thus partially or completely destroying the threads, during multiple couplings or de-couplings is of particular concern. Threads having been destroyed in this fashion might not fail until the weight of the string of tubulars is born by such threads, thus potentially resulting in the string of tubulars dropping into the well, the removal of which being extremely difficult. In addition, making up a threaded connection properly is time consuming.

In order to reduce the likelihood of damaging the threads of tubulars as they are installed, and to reduce cycle times, prior tubular gripping apparatuses have been developed which grip the outside or inside of the tubular rather than engaging the threads.

Other challenges encountered by using the drive apparatus to impart rotation include the fact that the drive apparatus is extremely heavy, and as such hoisting systems provided for moving the drive apparatus, as well as the tubular string weight it carries, are designed to apply extremely large forces. It should be appreciated that as an extending tubular is being threaded, it is also to be simultaneously lowered to make up or compensate for the distance of respective threads, i.e. the height of the threads between the edge when the threads first begin to engage, and after they become fully engaged. While the extending tubular is comparatively light with respect to the drive apparatus itself, the weight of the tubular itself can also be sufficient to cause the threads to strip, particularly when only a few are engaged. As such, it should be appreciated that a device capable of supporting the weight of the tubular as it is being threaded would provide further protection against stripping or other damage to the threads. While the drive apparatus is capable of lifting and aligning the extending tubular to some extent, utilizing the motors that reposition the drive apparatus to provide fine control as the extending tubular is just beginning to engage the threads of the exposed top tubular often results in stripping of the threads and destruction of the tubular as these motors apply far too much force.

Overcoming these challenges becomes increasingly important particularly because, even if the damaged threads are discovered prior to the string of tubulars falling into the well, such stripping then causes not only the extending tubular to become useless, but the string of tubulars must then be pulled up, the top tubular removed and a new one installed in its place, thus increasing casing installation times and costs.

The tubular threading system of the present invention overcomes many of the deficiencies discussed above by providing a thread compensation apparatus operable to support the extending tubular about a top tubular, and to cause the threads of the extending tubular to engage the threads of the top tubular of the string of tubulars in a near weightless state.

In one aspect, a tubular threading system is provided for threading tubulars and extending such tubulars into a well. The tubular threading system can include a drive apparatus having a rotating shaft. A thread compensation apparatus can be coupled to the drive apparatus via a drive connection of the thread compensation apparatus. The drive connection can comprise an outer portion coupled to the drive apparatus, and an inner portion coupled to the rotating shaft of the drive apparatus, wherein the inner portion rotates with the rotating shaft of the drive apparatus. The thread compensation apparatus can also comprise a sleeve rotatable with the inner portion of the drive connection, the inner portion imparting rotation to the sleeve, and the sleeve being rotatable relative to the outer portion of the drive connection. A lower shaft can engage the sleeve about a proximal end, such that the sleeve imparts rotation to the lower shaft, the lower shaft also being displaceable relative to the sleeve. The thread compensation apparatus can further comprise an actuator, which can be coupled to the outer portion of the drive connection, the actuator operating to displace the lower shaft relative to the sleeve. The lower shaft can also include a connection interface about its distal end for facilitating connection of the lower shaft to another component. For example, the lower shaft can comprise a connection interface configured and operable to connect to a tubular gripping apparatus as part of the tubular threading system. The tubular gripping apparatus can be configured to receive and grip an extending tubular for connection to a string of tubulars having a top tubular. The top tubular can have an exposed end configured to be coupled to a distal end of the lower shaft of the thread compensation apparatus. The thread compensation apparatus can effectively transmit rotation, axial load and drilling fluid from the drive apparatus. The one or more actuators can lift the lower telescoping assembly to provide thread compensation during thread makeup. In essence, the thread compensation apparatus can lift or support the extending tubular (and the telescoping of translating components within the thread compensation apparatus) during the threading process with the actuators partially retracted, so as to effectively suspend the extending tubular in a floating state or condition to provide thread compensation during threading. As threading takes place, the one or more actuators are caused to extend to allow the extending tubular to lower into and thread onto the connection with the top tubular. Once the connection is made, the drive apparatus lifts the string of tubulars. The actuators can be configured to extend until a limiting system within the thread compensation apparatus engages, wherein the axial load is transferred from the lower shaft to the upper shaft of the thread compensation apparatus.

In another aspect, a thread compensation apparatus is provided. The thread compensation apparatus can comprise a drive connection having an outer portion configured to couple to a drive apparatus, and an inner portion having a drive interface configured to couple to a rotating shaft of the drive apparatus. The thread compensation apparatus can further comprise a sleeve rotatable with the inner portion of the drive connection, the inner portion imparting rotation to the sleeve, and the sleeve being rotatable relative to the outer portion of the drive connection. The thread compensation apparatus can also comprise a lower shaft having proximal and distal ends, wherein the lower shaft can engage the sleeve about the proximal end, such that the sleeve imparts rotation to the lower shaft, the lower shaft being displaceable relative to the sleeve. The lower shaft can comprise a connection interface about the distal end, for example one being configured to couple to a tubular gripping apparatus. The thread compensation apparatus can further comprise an actuator coupled to the outer portion of the drive connection, wherein the actuator operates to displace the lower shaft with respect to the sleeve.

In another aspect, a method of threading tubulars is provided. The method of threading tubulars can comprise coupling a thread compensation apparatus to a drive apparatus, the thread compensation apparatus having a drive connection interface with an outer portion and an inner portion. The drive apparatus can comprise an outer body and a rotating drive shaft, wherein the inner portion of the drive connection interface is coupled to the rotating drive shaft. The method can further comprise coupling a tubular gripping apparatus to a lower shaft of the thread compensation apparatus via a connection interface located about a distal end of the lower shaft. Then an extending tubular can be inserted into and gripped by the tubular gripping apparatus. An actuator of the thread compensation apparatus can then be retracted so as to cause the thread compensation apparatus to be in a first retracted position, which position can comprise a nearly fully retracted position (i.e., not fully retracted). The drive apparatus can then be repositioned in order to position the extending tubular such that an end of the extending tubular is substantially coaxial with and proximal an exposed end of a top tubular of a string of tubulars. Once in proper position, the extending tubular can be caused to engage the top tubular. The drive shaft of the drive apparatus can then be rotated so as to impart rotation to the inner portion of the drive connection interface, which thereby imparts rotation to a sleeve and the lower shaft, wherein the lower shaft further imparts rotation to the tubular gripping apparatus and finally to the extending tubular. While the drive shaft is rotating, and as the extending tubular is threaded onto the top tubular, an actuator of the thread compensation apparatus can be caused to extend so as to displace the lower shaft of the thread compensation apparatus with respect to the sleeve. Such displacement can cause a corresponding displacement of the extending tubular until it is threaded onto the top tubular. Indeed, rotation of the lower shaft and the extending tubular, and displacement of the lower shaft, can continue until the threads of the extending tubular and threads of the top tubular are fully engaged. After the threads are fully engaged the extending tubular becomes a new top tubular of the string of tubulars and the drive apparatus can then lift and lower the string so that the process can be repeated as necessary to thread additional tubulars onto the string of tubulars.

With reference to FIGS. 1-3B, illustrated is a tubular threading system 10 in accordance with one example of the present disclosure. The tubular threading system 10 can include a drive apparatus 2 (e.g., a top drive), a thread compensation apparatus 110, and a tubular gripping apparatus 4. The tubular gripping apparatus 4 grips or otherwise holds an extending tubular 28 intended to be coupled to an exposed end 24 of a top tubular 20 being part of a string of tubulars (not shown) extending below the top tubular 20 down into a well 14. The drive apparatus 2 imparts rotation to the extending tubular 28 so as to cause threads of the extending tubular 28 to engage exposed threads of the top tubular 20 for threading the extending tubular 28 onto the top tubular 20. The thread compensation apparatus 110 is configured to make up or compensate for the axial distance the extending tubular 28 travels during engagement of the threads and threading of the extending tubular 28 to the top tubular 20. In addition, as the extending tubular 28 is repositioned to line up the threads, the thread compensation apparatus 110 acts to cushion the extending tubular 28 in the event it is lowered too hard into the top tubular 20. This ability to cushion the extending tubular 28 is facilitated by the selective positioning and control of the actuators of the thread compensation apparatus 110, which enables the extending tubular to effectively be suspended in a floating state or condition of weightlessness. This concept is explained in further detail below and is made possible in all embodiments.

It will be appreciated that the drive apparatus 2 can be configured to apply a torque. In order to apply a torque, the drive apparatus 2 can comprise a rotating shaft 40 which rotates with respect or relative to an outer member 52, wherein the torque is transferred to the rotating shaft 40 by exerting a counter-force against the outer member 52. The outer member 52 can further include a backup wrench 44 which can be locked, and which is capable of applying a reacting torque to the rotating shaft 40, the reacting torque being in the opposite direction of the torque applied by the drive apparatus 2. The drive apparatus 2 can be coupled to a platform 6, via a hoisting system (not shown) which has motors and or other machinery for lifting or repositioning the drive apparatus with respect to the well 14.

The thread compensation apparatus 110 of the present invention is shown as being attached to the rotating shaft 40 of the drive apparatus 2. The thread compensation apparatus 110 includes a rotating inner portion 122 and a non-rotating outer portion 118. The rotating inner portion 122 is connected to the drive apparatus 2 at an upper end via a drive connection 114, wherein the rotating inner portion 122 is configured to transfer a torque to a lower end of the thread compensation apparatus 110 having a connection interface such as one configured to interface with a tubular gripping apparatus 4, whereby rotation is provided to the tubular gripping apparatus 4. In this manner, the tubular gripping apparatus 4, which is holding or supporting an extending tubular 28 to be added to the string of tubulars 20, can thus rotate the extending tubular 28 in order to cause engagement and threading of the threads and connecting of the extending and top tubulars 28 and 20, respectively.

Additionally, the thread compensation apparatus 110 includes an outer portion 118. The outer portion 118 is coupled to or comprises one or more actuators 190, which allow for extension of the thread compensation apparatus 110 as the threads 26 and 32 of the top tubular 20 and the extending tubular 28, respectively, are engaged causing the extending tubular 28 and the top tubular 20 to draw together and connect to one another. The at least one actuator 190 is configured to connect at a first end 194 to the outer portion 118 via an upper connection interface 120. The actuator 190 is also configured to connect at a second end 198 to a telescoping lower shaft 170 via a lower shaft adapter 160 having a lower attachment interface 162. The lower shaft 170 is coupled to the inner rotating portion 122 of the thread compensation apparatus 110 and spins with the inner rotating portion 122, but extends or retracts with the extension or retraction of the actuators 190. It will be appreciated that the one or more actuators 190 are stationary with respect to the backup wrench 44 of the drive apparatus 2. In this way the lower shaft 170 is capable of displacing with respect to the rotating inner portion 122 of the thread compensation apparatus 110 and the drive shaft 40 of the drive apparatus 2 in order to maintain support of the tubular gripping apparatus 4 and the extending tubular 28 and to compensate for the distance or length of the threads 32 and 26 of their respective tubulars as threading occurs. The one or more actuators 190 can be operable with electrical control wires, hydraulic supply lines, pneumatic supply lines, etc., depending upon the type of actuator(s) employed.

The actuators 190 can be of various types, such as hydraulic, pneumatic, screw gear, or any other type operable to linearly displace to cause linear displacement of the lower shaft of the thread compensation apparatus 110. The actuators 190 are designed to be able to extend and to retract and to be of sufficient strength so as to be able to hold the weight of the tubular gripping apparatus 4 as well as the weight of the extending tubular 28 in an at least partially retracted position. In this manner, for each iteration of adding a new extending tubular 28, a tubular can have a top end inserted into the tubular gripping apparatus 4, and the drive apparatus 2 can be moved so as to position the bottom end of the extending tubular 28 into the general location of, but coaxially with, the exposed top end 24 of the top tubular 20 of the string of tubulars. The drive apparatus 2 can then be used to impart rotation to the extending tubular 28 while the actuators 190 can be allowed to extend, thus lowering the extending tubular 28, as the threads 32 and 26 are engaged.

It will be appreciated that the one or more actuators 190 can be arranged so as to be parallel to the axis of the inner rotating portion 122. However the one or more actuators 190 can be arranged in a non-parallel fashion, as shown. It will be appreciated by one of ordinary skill, that in the non-parallel configuration, the ends of the one or more actuators 190 can be configured to pivot about their respective connection points so as to permit the necessary angular displacement of the actuators 190 at the connection points as the actuators 190 extend or retract.

Located or positioned below the thread compensation apparatus 110 is the tubular gripping apparatus 4, which connects to the lower shaft 170 of the thread compensation apparatus 110 via a lower connection interface. The tubular gripping apparatus 4 can be provided with a clamping device 60 configured to initially grasp the exterior portion of the extending tubular 28 and bring the tubular coaxially in alignment with the tubular gripping apparatus, wherein the tubular is inserted into the tubular gripping apparatus 4, which then grips the tubular such that the tubular gripping apparatus 4 can transfer torque and axial loads. As the lower shaft 170 rotates, the tubular gripping apparatus 4 also rotates, thereby imparting rotation to the extending tubular 28 in order to thread it onto the top tubular 20 of the string of tubulars.

It will also be appreciated that a control system 650 can be provided, which can operate both the rotation and positioning of the drive apparatus 2, the rotation of the backup wrench 44, the extension or retraction of the one or more actuators 190, and the tubular gripping apparatus 4. The control system 650 can be utilized to provide any desired motion of each of the respective elements of the system 10 at any given time from a centralized location, and can receive input from a controller or user of the system 10. For example, the control system 650 can control the actuators of the thread compensation apparatus 110 to apply a predetermined force to retract and extend the actuators as needed, to locate the actuators in a pre-determined position, etc. The control system 650 can further be configured to control any sensors associated with any of the components within the tubular threading system 10, and particularly the thread compensation apparatus 110.

With reference to FIGS. 4-13, illustrated is an exemplary thread compensation apparatus, shown generally at 210. The thread compensation apparatus 210 includes a drive connection, shown generally at 214. The drive connection 214 has an outer portion 218 and a rotating inner portion 222.

The rotating inner portion 222 is configured to couple to the rotating shaft of the drive apparatus (not shown) while the outer portion 218 is configured to couple to a member of the drive apparatus (not shown). By rotating the inner portion 222, rotation can be imparted to a housing 310 which contains a sleeve 330, which further imparts rotation to the lower shaft 270. The outer portion 218 has an upper attachment interface 220, which is connected to a first end 394 of an actuator 390. The one or more actuators 390 comprise a second end 398 coupled to a lower shaft adapter 260 via a lower attachment interface 262. The lower shaft adapter 260 and the lower attachment interface 262 are configured to interface with the rotating shaft 270. As discussed above, extension or retraction of the one or more actuators 390 can cause the lower shaft 270 to displace axially with respect to the drive apparatus (not shown).

The lower shaft 270 is provided with a lower connection interface, such as about its distal end 272. In one example, the lower shaft 270 can comprise a lower connection interface 274 configured and operable to connect to a tubular gripping apparatus (not shown, but see discussion above and FIGS. 1-3B). In this manner, axial displacement of the lower shaft 270 will also cause the tubular gripping apparatus (not shown), and an extending tubular (not shown) being supported thereby, to similarly displace axially while maintaining the ability to independently rotate. In other examples, the lower connection interface 274 of the lower shaft 270 can be configured and operable to connect with other components, devices, tools or equipment, such as a torque sub, a crossover, etc., as will be recognized by those skilled in the art. In such cases, the lower connection interface 274 can comprise a different configuration, shape, type, etc. designed to interface and operate with whatever it is being connected to, wherein the thread compensation apparatus is indirectly coupled to the tubular gripping apparatus through one or more of these components, devices, tools or equipment pieces.

In this first embodiment, the housing 310, and the sleeve 330 can be rigidly coupled to the rotating inner portion 222 of the drive connection 214. Such a rigid connection can be achieved by bolts 350, which extend through flanges provided on each of the rotating inner portion 222, the housing 310, and the sleeve 330. It can be readily appreciated that the rotating inner portion 222, the housing 310, and the sleeve 330 can be coupled via numerous methods, including welding, threading, bonding, or any number of other coupling methods. Alternatively, the rotating inner portion 222, the housing 310, or the sleeve 330 can also be formed of a unitary piece of material or coupled to one another in any combination. However, bolts 350 can provide a secure, but removable connection, which can allow for easier and more rapid assembly and disassembly, such as for maintenance or other reasons. As such, a rigid connection between the rotating inner portion 222, allows for a torque applied by the drive apparatus to be transferred through the thread compensation apparatus 210 by transferring the torque through the rotating inner portion 222, to the housing 310 as well as the sleeve 330, and thereby to the lower shaft 270, and finally to the tubular gripping apparatus (not shown) attached to the lower shaft 270.

In order to facilitate transferring the above mentioned torque, the sleeve 330 can be provided with a series of primary splines, channels, or keys 334 along its outer surface. The lower shaft 270 can be coupled at a proximal end 278 to the sleeve 330. The proximal end 278 of the lower shaft 270 can be annular and provided with a series of secondary splines, channels, or keys 286 along a portion of its inner surface. The secondary splines 286 correspond in shape and contour to the primary splines 334. The primary splines 334 and the secondary splines 286 can be provided as a plurality of slots or contours which parallel the axes of both the lower shaft 270 and the sleeve 330. In this manner the proximal end 278 of the lower shaft 270 can be configured to slide over lower distal end of the sleeve 330 and the primary splines 334 caused to mesh with and interface with the secondary splines 286. The slots or contours being parallel to the axes of the lower shaft 270 and the sleeve 330 allows for a coaxial displacement of the lower shaft 270 with respect to the sleeve 330. The contours of the primary and secondary splines 334, 286 can engage one another and allow for a torque applied to the sleeve 330 to be transferred to the lower shaft 270, thus imparting rotation to the lower shaft 270. In this manner, the lower shaft 270 can be extended or retracted by the actuator 390, while still being capable of transferring torque from the drive apparatus through the thread compensation apparatus 210 to the tubular gripping apparatus and the extending tubular.

It will be appreciated that the primary splines 334 are shown as being located on an outer surface of the sleeve 330, and corresponding secondary splines 286 are shown as being located on the inner surface of the proximal end 278 of the lower shaft 270. This orientation is not intended to be limiting and splines could be provided in numerous configurations, including an inner surface of the housing 310 with corresponding splines on an outer surface of the proximal end 278 of the lower shaft 270. Other alternative configurations can include providing the lower shaft 270 with a proximal end 278 that is larger than, and encompasses, the housing 310, wherein the primary splines are provided on an outer surface of the housing 310 and the proximal end 278 of the lower shaft 270 slides over the housing 310.

In order to facilitate relative rotation between the rotating inner portion 222 and the outer portion 218, a plurality of bearings 226 can be provided at the interface of the rotating inner portion 222 and the outer portion 218. Similarly, the lower shaft adapter 260, which is provided between the lower shaft 270 and the one or more actuators 390, can facilitate a rotating connection between the one or more actuators 390, which do not rotate, to the lower shaft 270, which does rotate. The lower shaft adapter 260 can be provided with a base portion 264 which is also stationary and provides a support base upon which the lower connection interface 262 is supported for connecting the lower shaft 270 and the second end of the actuator 390.

The lower shaft adapter 260 can also have supported therein a rotating collar 268, which rotates with the lower shaft 270. The rotating collar 268 can interface with the lower shaft 270 using a variety of interface types. Such collar interface types can include, but are not limited to, a slip collar operable to slide onto or otherwise interferingly fit over the lower shaft 270, split rings, clamps, tapered interference fits, etc. However, a raised adapter lip, or shoulder 276, on which the rotating collar 268 rests, can provide an advantage. The adapter shoulder 276 can have an outer major diameter being larger than an inner diameter of the rotating collar 268, which allows for rotating collar 268 to abut against the adapter shoulder 276 and essentially lift the lower shaft 270 when the one or more actuators 390 are retracted.

It can also be appreciated that the rotating collar 268 can also rotate on a plurality of bearings 266 which reside between the rotating collar 268 and the base portion 264 of the lower shaft adapter 260. Alternatively, the rotating collar 268 can act as a bushing or be provided with a secondary bushing in lieu of bearings in order to facilitate rotation of the lower shaft 270 with respect to the one or more actuators 390. One of ordinary skill in the art will recognize a plurality of connection or interfacing methods which would facilitate such rotation.

Such retraction of the one or more actuators 390 to an interim position functions to lift the lower shaft 270, wherein the load of lifting the lower shaft, tubular gripping apparatus (not shown), and the extending tubular (not shown), prior to threading the extending tubular onto the exposed top end of the top tubular of the string of tubulars, can be home by the one or more actuators 390. The one or more actuators 390, by retracting, can bear the weight of the extending tubular (not shown) and the tubular gripping apparatus (not shown), wherein the extending tubular is allowed to float in a near weightless configuration. It is noted that the retracted position discussed herein comprises a position of the actuators between fully extended and fully retracted, such as in an almost or nearly fully retracted position (where the actuators are not fully retracted), wherein additional travel remains that can accommodate further retraction of the actuators. In other words, the actuators comprise a nearly fully retracted position (i.e., not fully retracted), thus enabling the extending tubular to "float." In this position, the actuators can be controlled to exert a constant force to retract. If an upward force is applied or experienced (e.g., as a result of two tubulars hitting one another as they are being lined up prior to threading) the actuators can be caused to further retract and therefore dampen or cushion the impact. Likewise, if a downward force is applied or experienced (e.g., as the threads from two tubulars mesh into each other) the actuators can be caused to extend. This weightless configuration allows for a greatly reduced likelihood of stripping the threads between the extending tubular and the exposed top tubular of the string of tubulars as they are caused to engage one another, particularly when only partially engaged. This reduced likelihood of stripping is made possible as the threads are not subject to external forces from the weight of the extending tubular, the tubular gripping apparatus, the drive apparatus or the thread compensation apparatus. Rather, the one or more actuators 390 can be caused to extend, at least partially, as the threads of the extending and top tubulars engage one another, the one or more actuators 390 determining the force which needs to be overcome in order to extend as the threads between the extending tubular and the top tubular engage one another.

When the extending tubular is fully threaded and engaged with the top tubular of the string of tubulars the one or more actuators will be in a partially extended position. The drive apparatus can then be actuated to lift the string of tubulars. As the drive apparatus begins to lift the string of tubulars, the actuators will continue to extend until the limiting system engages. In this configuration, the entire assembly, and the string of tubulars, can then be lifted using the thread compensation apparatus in order to disengage the floor slips, the floor slips being shown in FIG. 2. While some actuators can be provided which are capable of supporting the weight of the string of tubulars as the string gets particularly long, it has been recognized that a shaft shoulder 282 can be provided on the proximal end 278 of the lower shaft 270, as well as a corresponding load shoulder 314 being provided on the interior surface of the housing 310, which corresponds in shape to the shaft shoulder 282. The shaft shoulder 282 can be configured to seat on or about the load shoulder 314 upon the lower shaft 270 displacing a certain distance. The load shoulder 314 can be provided as a unitary protrusion formed out of a continuous piece of material with the housing 310. However, the load shoulder 314, as shown herein, is shown as a separate piece which can be bonded or otherwise coupled to the end of the housing 310. Such a configuration can provide for easier assembly and disassembly as may be required.

When the shaft shoulder 282 abuts or seats against the load shoulder 314, the thread compensation apparatus 210 can be said to be in an extended position. This extended configuration is shown in particular in FIG. 5, noting that the at least one actuator 390 is partially, but not fully, extended when the shaft shoulder 282 is seated on or about the load shoulder 314. Additional extending travel can be provided in the actuator when the shaft shoulder 282 abuts or seats against the load shoulder 314 to ensure that when the tubular string is lifted, the actuator(s) is/are not supporting the weight of the string of tubulars, but rather the shaft shoulder 282. On the other hand, when the at least one actuator 390 is retracted and the shaft shoulder 282 is unseated from the load shoulder 314, the thread compensation apparatus 210 can be said to be in a retracted position. In one exemplary operating scenario, the actuators 390 can be caused to be in an almost or nearly fully retracted position (i.e., not fully retracted), thus providing the "floating" state or condition of the various components as discussed herein. This nearly or almost fully retracted position is shown in particular in FIG. 6, noting that the at least one actuator 390 is nearly fully retracted and the shaft shoulder 282 is disengaged from the load shoulder 314. This is one example of a built-in limiting system within the thread compensation apparatus 210, which limiting system functions to limit the displacement of the translating components of the thread compensation apparatus 210.

It can also be appreciated that the thread compensation apparatus 210 can further travel through and stop at various interim positions being located somewhere between the most retracted position and the most extended position. These interim positions can be utilized in various situations, one situation in particular being while the tubular gripping device and the extending tubular are being supported in the weightless configuration near to a desired location about the exposed end of the top tubular of the string of tubulars so as to provide a limited degree of displacement, as necessary, in order to raise or lower the extending tubular using the one or more actuators 390 rather than the motors of the drive apparatus. Indeed, the actuators 390 can be actuated to position the extending tubular in the most optimal position for engaging the top tubular both before or during the threading procedure.

The thread compensation apparatus can further comprise one or more sensors operable to sense an operating characteristic within the thread compensation apparatus or one of its component parts. In one aspect, the sensors can be configured to sense and measure the position of the actuators, or measure the amount of extension of a one portion of the thread compensation apparatus relative to another portion of the thread compensation apparatus. The sensors can be located inside the actuator(s), on the actuator(s), and/or mounted on any outside portion of the thread compensation apparatus, as will be recognized by those skilled in the art. In one example, the sensor(s) can comprise a linear transducer located within one or more of the actuators. The linear transducer can further make it easier to control the "float" described herein. Additional sensors can be present, such as those configured to measure the weight or load supported by the actuators. Like the actuators, the sensors can be connected to and in communication with and controlled by a controller configured to control one or more operating functions of the thread compensation apparatus. In one example, the controller can be configured to apply a predetermined force to the actuators, to cause the thread compensation apparatus to essentially operate in a weightless state. In another example, the controller can be configured to retract the actuators to a predetermined position. Other control aspects may be implemented as will be recognized by one skilled in the art.

Figure 12:
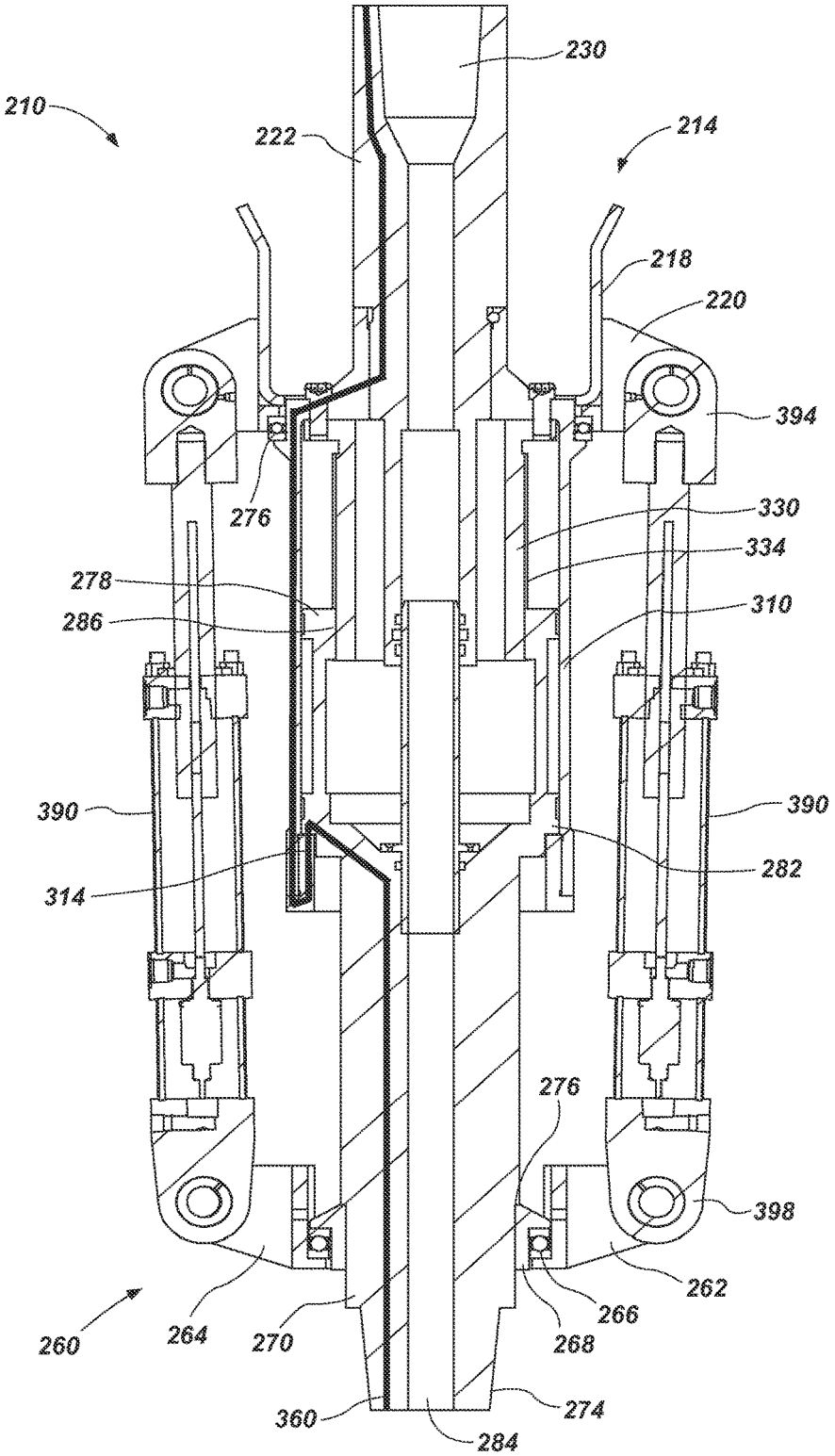
FIG. 12 illustrates a sectional view of the thread compensation apparatus of FIGS. 4 A-C further depicting an axial load path through the thread compensation apparatus.

In at least a partially extended position, with the limiting system engaged, as shown in FIG. 12 particularly, an axial load path, shown as the bold line 360, can extend from the tubular gripping apparatus (not shown), through the thread compensation apparatus 210 and on to the drive apparatus. The axial load 360 extends through the thread compensation apparatus 210 along the axial length of the lower shaft 270, through the shaft shoulder 282 and into the load shoulder 314, along the axial length of and through the housing 310, into and through the rotating inner portion 222, and from the rotating inner portion 222 into the drive apparatus (not shown).

Figure 13:
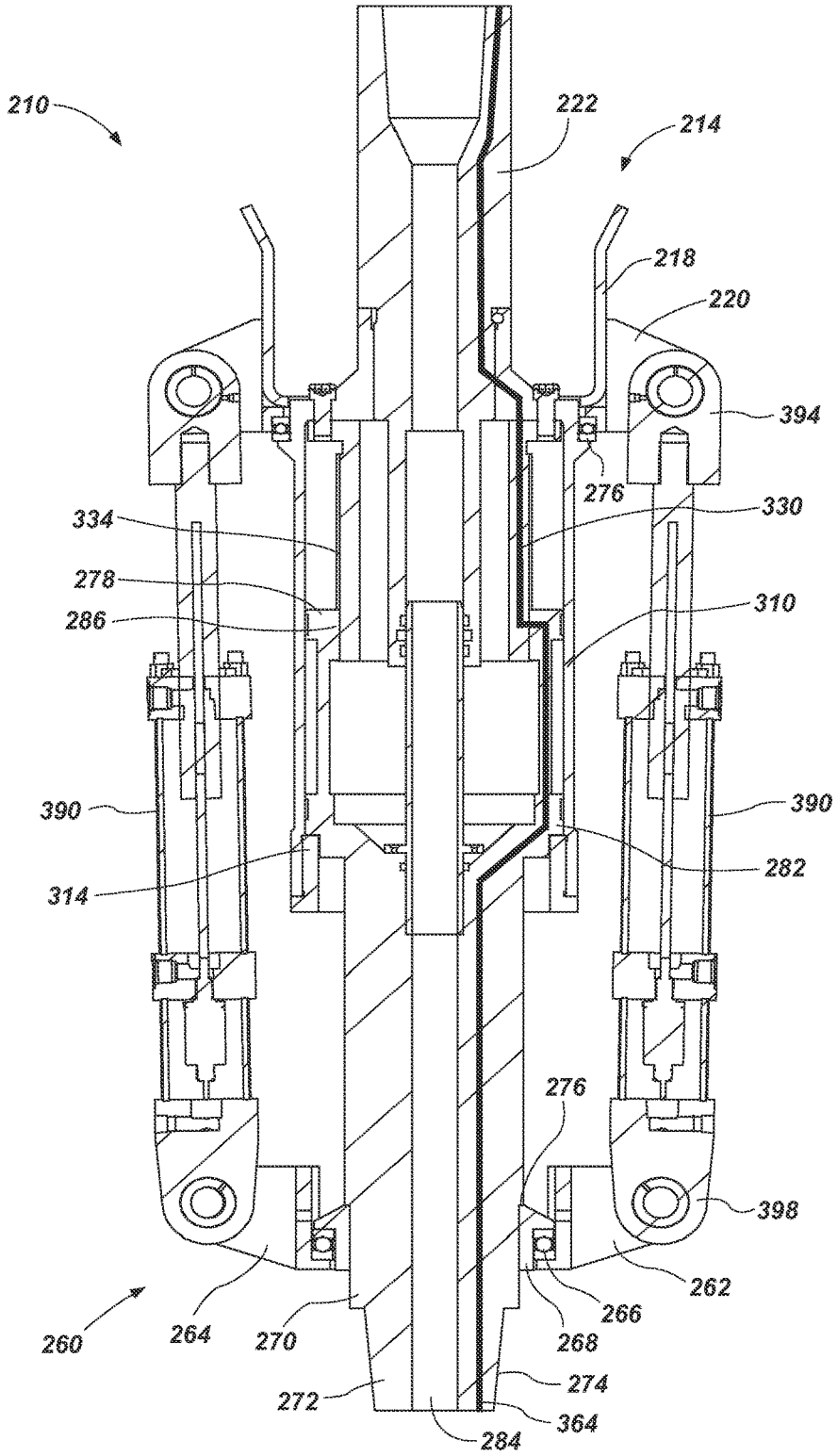
FIG. 13 illustrates a sectional view of the thread compensation apparatus of FIGS. 4 A-C further depicting a torsional load path through the thread compensation apparatus.
Figure 14A:
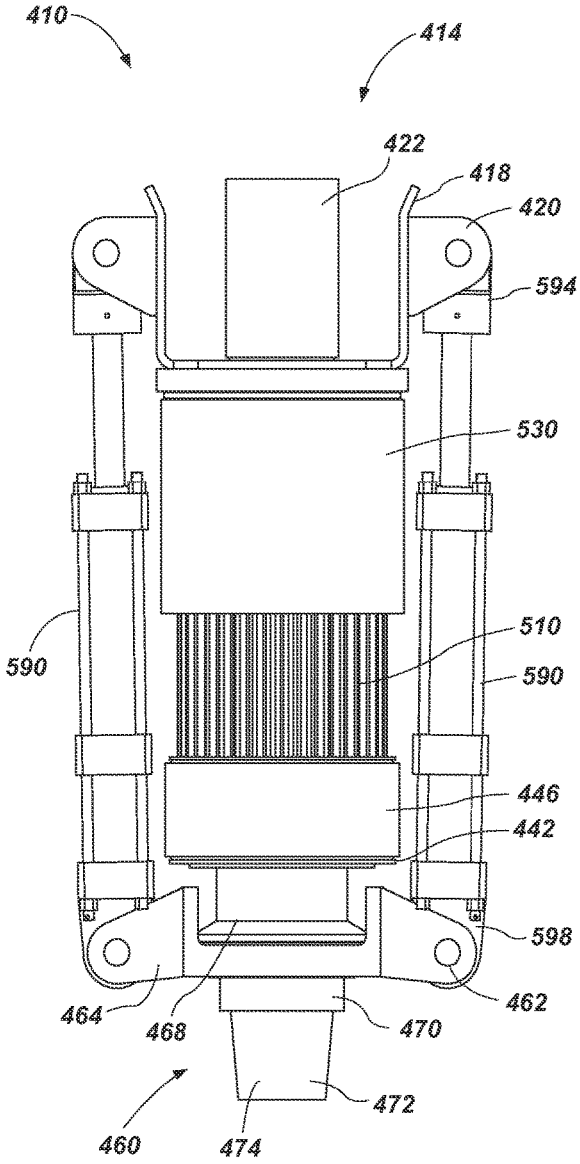
FIGS. 14 A-B illustrate various views of a thread compensation apparatus in accordance with another example of the present invention.
Figure 14B:
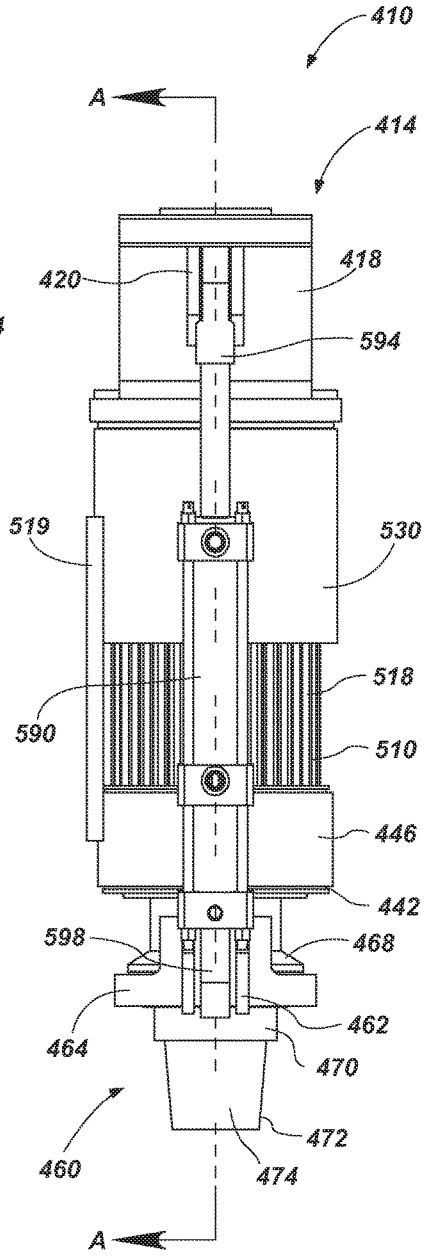

As shown in FIG. 13, a torsional load path can also extend from the drive apparatus (not shown), through the thread compensation apparatus 210, to the tubular gripping apparatus (not shown), and thereby to the extending tubular. In should be appreciated that the torsional load is transferred through the thread compensation apparatus 210 in any of the retracted, extended, or interim positions. The torsional load path is shown generally as the bold line 364. The torsional load 364 extends from the drive apparatus, through the rotating inner portion 222, into the sleeve 330, through the primary splines 334, and into the secondary splines 286. The secondary splines 286 then transfer the torsional load 365 through the lower shaft 270, into the tubular gripping apparatus (not shown), and into the extending tubular. In this manner, rotation can be imparted to the extending tubular so as to thread it into the exposed end of the top tubular of the string of tubulars.

Figure 10A:
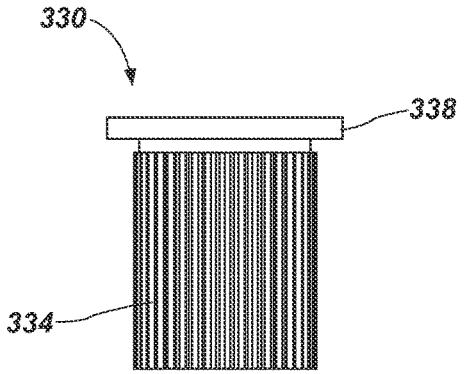
FIGS. 10 A-B illustrate front and bottom views, respectively, of a splined sleeve being part of the thread compensation apparatus of FIGS. 4 A-C.
Figure 10B:
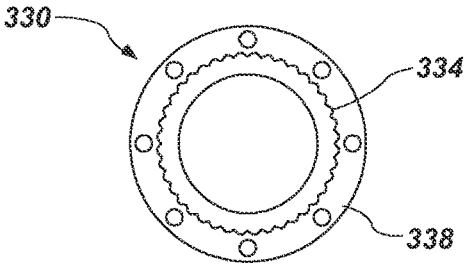

FIGS. 10A-B show side and bottom views respectively of the sleeve 330. As shown, the primary splines 334 are formed about the outer surface of the lower portion of the sleeve 330. The sleeve can further comprise a flange 338 configured to be bolted to the rotating inner portion of the drive connection (not shown).

Figure 11A:
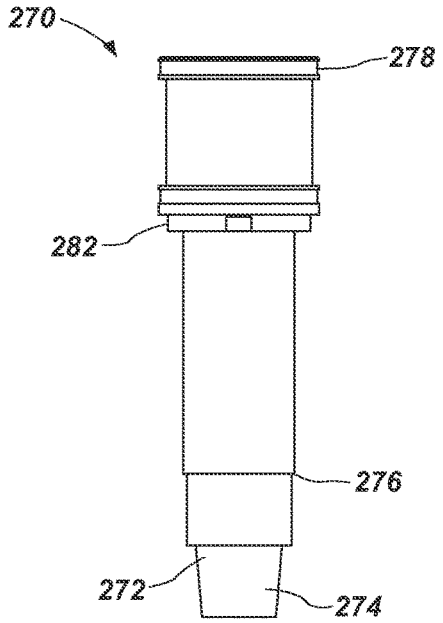
FIGS. 11 A-B illustrate front and top views, respectively, of a lower shaft being part of the thread compensation apparatus of FIGS. 4 A-C.
Figure 11B:
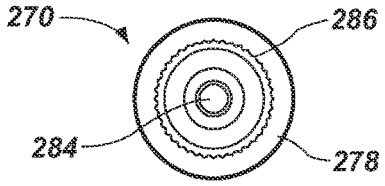

FIGS. 11A-B show side and top views respectively of the lower shaft 270. As shown, the proximal end 278 is annular, and has an interior cavity with an inner surface upon which the secondary splines 286 are located. The secondary splines 286 are configured to mesh with the primary splines 334, as discussed above. Also shown is the shaft shoulder 282 located about the distal end 278, configured to engage the load shoulder of the housing (not shown). Also as discussed above, the lower shaft 270 comprises an adapter shoulder 276 configured to engage the rotating collar of the lower shaft adapter (not shown). The lower shaft 270 can further include a lower connection interface 274, such as about its distal end 272. In one example, the lower connection interface 274 can be configured and operable to connect to a tubular gripping apparatus. The lower connection interface 274 provides an interface which can connect to a tubular gripping apparatus (or other structure (e.g., a torque sub or crossover)) via numerous methods as will be appreciated by one of ordinary skill in the art.

With particular reference to FIGS. 5, 6, 8, 9A-B, and 11B, one of ordinary skill will recognize that drilling fluid, or any other fluid or gas is typically used in the running of tubulars. This fluid needs to be pumped through the drive apparatus, the thread compensation apparatus 210, as well as through the tubular gripping apparatus and into or from the string of tubulars (not shown). Shown in the above referenced figures are a plurality of channels passing through the thread compensation apparatus 210. A drive channel 230 passes through the rotating inner portion 222, and a shaft channel 284 passes through the lower shaft 270. The shaft channel 284 and the drive channel 230 are fluidly connected via a mud sleeve 370. The mud sleeve 370 is provided with a flange 372 which engages (e.g., interferingly) a recess 376 located within the lower shaft 270. The mud sleeve 370 extends upwards from the shaft channel 284 and slidingly engages the sidewalls of the drive channel 230. The mud sleeve 370 is sufficiently long such that the upper section never exits the drive channel 230 throughout the entire range of motion of the thread compensation apparatus 210 between the fully extended and fully retracted positions. The mud sleeve 370 prevents mud from entering into and interfering with the axial displacement of the primary splines 286 and the secondary splines 334. The drive channel 230 can also be provided with a plurality of seals 374 that prevent the pressure of the mud within the drive channel from forcing its way between the mud sleeve 370 and the sidewalls of the drive channel 230 as the mud sleeve 370 moves therein. In essence, fluid is caused to pass through the drive channel 230, into the mud sleeve 370, and into the shaft channel 284 to provide a passageway for the fluid, and to prevent the high pressure fluid from escaping into the remaining portions of the thread compensation apparatus. Reciprocating seals 374 between the drive channel 230 and the mud sleeve 370 provide a seal that is maintained whether the thread compensation apparatus is in a retracted position, an extended position or in any position between these. Linear bearings 378 allow for smooth linear motion between the mud sleeve 370 and the drive channel 230. A static seal 380 can be located between the mud sleeve 370 and the lower shaft 270 to prevent leakage at that interface.

FIGS. 14-23 illustrate a thread compensation apparatus in accordance with another example, the thread compensation apparatus being shown generally at 410. The thread compensation apparatus 410 is similar in many respects to the exemplary thread compensation system discussed above, with some notable differences discussed below. The thread compensation apparatus 410 includes a drive connection, shown generally at 414. The drive connection 414 has an outer portion 418 and a rotating inner portion 422. The rotating inner portion 422 is configured to couple to the rotating shaft of the drive apparatus (not shown) while the outer portion 418 is configured to couple to a member of the drive apparatus (not shown). By rotating the inner portion 422, rotation can be imparted to a sleeve 530, which imparts rotation to a housing 510, which further imparts rotation to a lower shaft 470.

The outer portion 418 can have an upper connection interface 420 which is configured to couple to a first end 594 of an actuator 590. The actuator 590 can comprise a second end 598 coupled to a lower shaft adapter via a lower attachment interface. The lower shaft adapter and the lower attachment interface are configured to interface with the lower shaft 470. Extension or retraction of the actuator 590 can cause the lower shaft 470 to displace axially with respect to the drive apparatus. The lower shaft 470 is provided with a lower connection interface 474 at a distal end 472, such as a lower connection interface which connects to a tubular gripping apparatus (not shown). In this manner, axial displacement of the lower shaft 470 will also cause the tubular gripping apparatus (not shown), and an extending tubular (not shown) connected thereto, to similarly displace while also being able to independently rotate.

In this example, the sleeve 530 can be rigidly coupled to the rotating inner portion 422 of the drive connection 414. Such a rigid connection can be achieved by splines, such as splines 450 on the inner portion 422 that are caused to engage splines 454 on the sleeve 530 (see FIGS. 21-22B). It will be readily appreciated that the rotating inner portion 422 and the sleeve 530 can be coupled via numerous methods, including bolts, welding, threading, bonding, or any number of other coupling methods. Alternatively, the rotating inner portion 422 and the sleeve 330 can also be formed of a unitary piece of material. However, as discussed above with reference to the first example thread compensation apparatus, a coupling method that provides a secure, but removable connection, can allow for easier and more rapid assembly and disassembly, such as for maintenance or other reasons. A rigid connection between the rotating inner portion 422, allows for a torque applied by the drive apparatus to be transferred through the thread compensation apparatus 410 by transferring the torque through the rotating inner portion 422, to the sleeve 530, to the housing 510, and thereby to the lower shaft 470, and finally to the tubular gripping apparatus (not shown) attached to the lower shaft 470. FIG. 21A further illustrates a groove 425 formed into the inner portion 422 for receiving a retaining ring (not shown) as still one additional way to achieve a rigid connection between the inner portion 422 and the sleeve 530.

Figure 18:
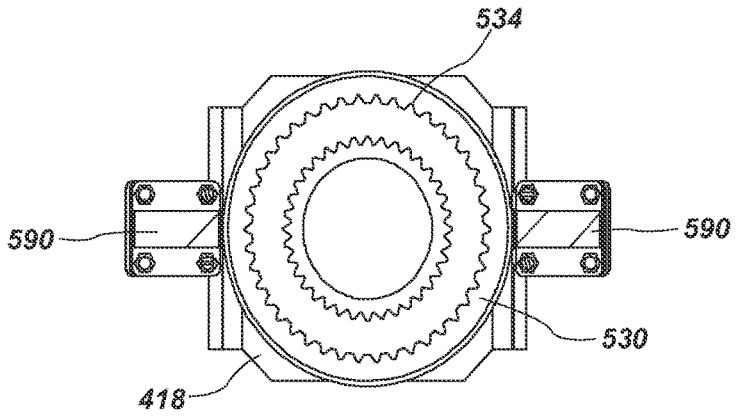
FIG. 18 illustrates a sectional view of the thread compensation apparatus of FIGS. 14 A-B, as taken along the line C-C of FIG. 17A.
Figure 19:
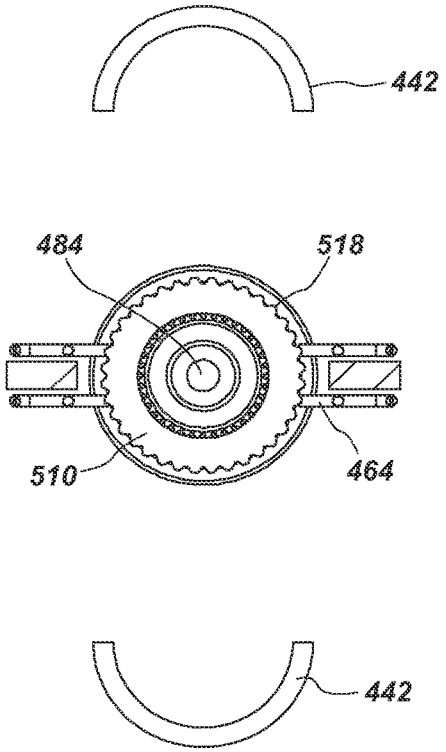
FIG. 19 illustrates a sectional view of the thread compensation apparatus of FIGS. 14 A-B, as taken along the line D-D of FIG. 17A.

In order to facilitate transferring the above mentioned torque, the sleeve 530 can be provided with a series of primary splines, channels, or keys 534 along its inner surface, the primary splines being best shown in FIG. 18. The housing 510 can be configured to slide or otherwise fit into or engage the sleeve 530. The housing 510 is provided with a series of secondary splines, channels, or keys 518 along its outer surface. The secondary splines 518 correspond in shape and contour to the primary splines 534, these being caused to engage and mate with one another. The primary splines 534 and the secondary splines 518 can be formed as a plurality of slots or contours which parallel the axes of both the housing 510 and the sleeve 530. The lower shaft 470 can be coupled, at a proximal end 478, to a distal end 512 of the housing 510. In this manner the housing 510 can slide into the sleeve 330 and the primary splines 534 mesh with and interface with the secondary splines 518. The axially parallel slots of the primary splines 534 and the secondary splines 518 allows for a coaxial displacement of the housing 510 with respect to the sleeve 530. Meanwhile, the meshing and engaging of the primary and secondary splines 534, 518 allows for the transfer of a torque applied to the rotating inner portion 422, and thereby to the sleeve 530, to be transferred into the housing 510, and thereby to the lower shaft 470, thus imparting rotation. In this manner, the lower shaft 470 can be extended or retracted by the one or more actuators 590 for positioning the extending tubular (not shown), while still being capable of transferring torque from the drive apparatus through the thread compensation apparatus 410 to the extending tubular (not shown).

To prevent debris and water or other fluids from entering the inside of the thread compensation apparatus 410, a cover 519 can be provided. The cover 519 can be secured to various components of the thread compensation apparatus 410 as necessary, and configured to cover any exposed components or elements. The cover 519 can comprise many different sizes, types, etc. as will be recognized by those skilled in the art.

In order to facilitate more efficient relative rotation between the rotating inner portion 422 and the outer portion 418, a plurality of bearings 426 can be provided to interface the rotating inner portion 422 to the outer portion 418. Similarly, a lower shaft adapter 460 having a lower attachment interface 462 can be provided between the lower shaft 470 and the one or more actuators 590. The lower shaft adapter 460 facilitates a connection of the one or more actuators 590 to the lower shaft 470, which rotates. The lower shaft adapter 460 can be provided with a base portion 464 for supporting the lower attachment interface 462. The lower shaft adapter 460 can also include a rotating collar 468 which rotates with the lower shaft 470.

The rotating collar 468 can interface with the lower shaft 470 via a plurality of methods. The rotating collar 468, as shown in this example, can be provided as solid collar which slips over the lower shaft 470. The rotating collar 468 can interface with the lower shaft 470 in any number of ways. Such interfaces can include split rings, clamps, tapered interference fits, etc. However, in practice providing the lower shaft 470 with a raised adapter lip or shoulder 476, onto which the rotating collar 468 rests, has provided some advantage. The adapter shoulder 476 can have an outer major diameter being larger than an inner diameter of the rotating collar 468, which allows for the rotating collar 468 to abut against the adapter shoulder 476 and lift the lower shaft 470 when the actuator 590 is retracted.

It can also be appreciated that the rotating collar 468 can also rotate on a plurality of bearings 466 which reside between the rotating collar 468 and the base portion 464 of the lower shaft adapter 460. Alternatively, the rotating collar 468 can act as a bushing or be provided with a secondary bushing in lieu of bearings in order to facilitate rotation of the lower shaft 470 with respect to the at least one actuator 590. One of ordinary skill in the art will recognize a plurality of connection or interfacing methods which would facilitate such rotation.

Further, the lower shaft 470 can be connected at a proximal end 478 to a distal end 512 of the housing 510 by providing a series of keyed flanges which are caused to engage one another and are held together by a set of split rings 442. The split ring 442 provides a rigid connection both rotationally and axially between the lower shaft 470 and the housing 510. The split rings 442 can be locked together by an outer sleeve 446. It should be appreciated that numerous connection interfaces can be provided including male and female threads, bolts, or otherwise. Alternatively the housing 510 and the lower shaft 470 can further be formed of a unitary piece of material. However, the split rings 442 and the corresponding outer sleeve 446 can be beneficial for purposes of assembly and disassembly during maintenance or otherwise.

Actuation of the one or more actuators 590 can function to retract them, and facilitate lifting of the lower shaft 470. The load from lifting the lower shaft, tubular gripping apparatus (not shown), and the extending tubular (not shown), prior to threading the extending tubular onto the exposed top end of the top tubular of the string of tubulars, can be borne by the thread compensation apparatus 410 with the actuators 590. With the one or more actuators 590 bearing the weight of the extending tubular (not shown) and the tubular gripping apparatus (not shown), the extending tubular is essentially caused to float in a near weightless configuration about the exposed end of the top tubular of the string of tubulars. This weightless configuration greatly reduces the likelihood of stripping the threads between the extending tubular and the exposed top tubular of the string of tubulars as they are caused to engage one another, particularly when only partially engaged. Such reduced likelihood of stripping is made possible as the threads are not subject to external forces from the weight of the extending tubular, the tubular gripping apparatus, the drive apparatus or the thread compensation apparatus. Rather, the one or more actuators 590 can be caused to extend as the threads of the extending and top tubulars engage one another, the one or more actuators 590 determining the force which needs to be overcome in order to extend as the threads between the extending tubular and the top tubular engage one another.

When the extending tubular is fully threaded and engaged with the top tubular of the string of tubulars the one or more actuators will be in at least a partially extended position. Actuating the drive apparatus to lift the string of tubulars will cause the one or more actuators to extend further until the limiting system within the thread compensation apparatus becomes engaged, at which time the entire assembly (including the thread compensation apparatus, the string of tubulars) can then be lifted in order to disengage the floor slips, the floor slips being shown in FIG. 2. As discussed above, while some actuators can be provided which are capable of supporting the weight of the string of tubulars as the string gets particularly long, it has been recognized that an exterior shoulder 424 can be provided on the distal end of the rotating inner portion 422. Further, a corresponding load shoulder 514 can be provided on the interior surface of the housing 510, which corresponds in shape to the exterior shoulder 424. As the thread compensation apparatus 410 extends, the load shoulder 514 catches or seats on the exterior shoulder 424 when the housing 510, and the lower shaft 470 connected thereto, displaces a certain axial distance. In this configuration, the thread compensation apparatus 410 is configured to lift the load of the string of tubulars and the tubular gripping apparatus, with the load path bypassing the actuator(s).

Figure 15:
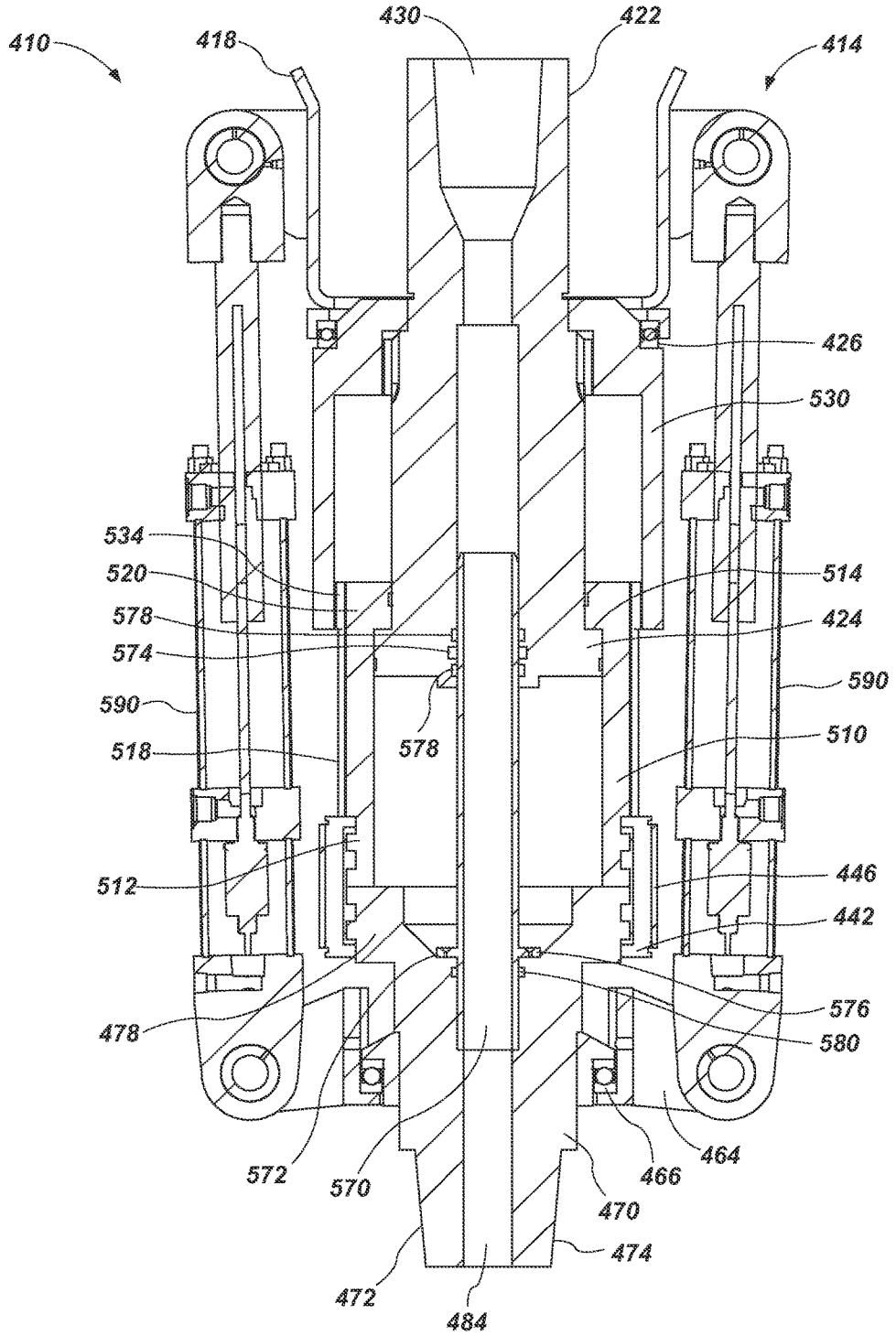
FIG. 15 illustrates a front sectional view of the thread compensation apparatus of FIGS. 14 A-B, as taken along the line A-A of FIG. 14B, and as shown in an extended configuration.
Figure 16:
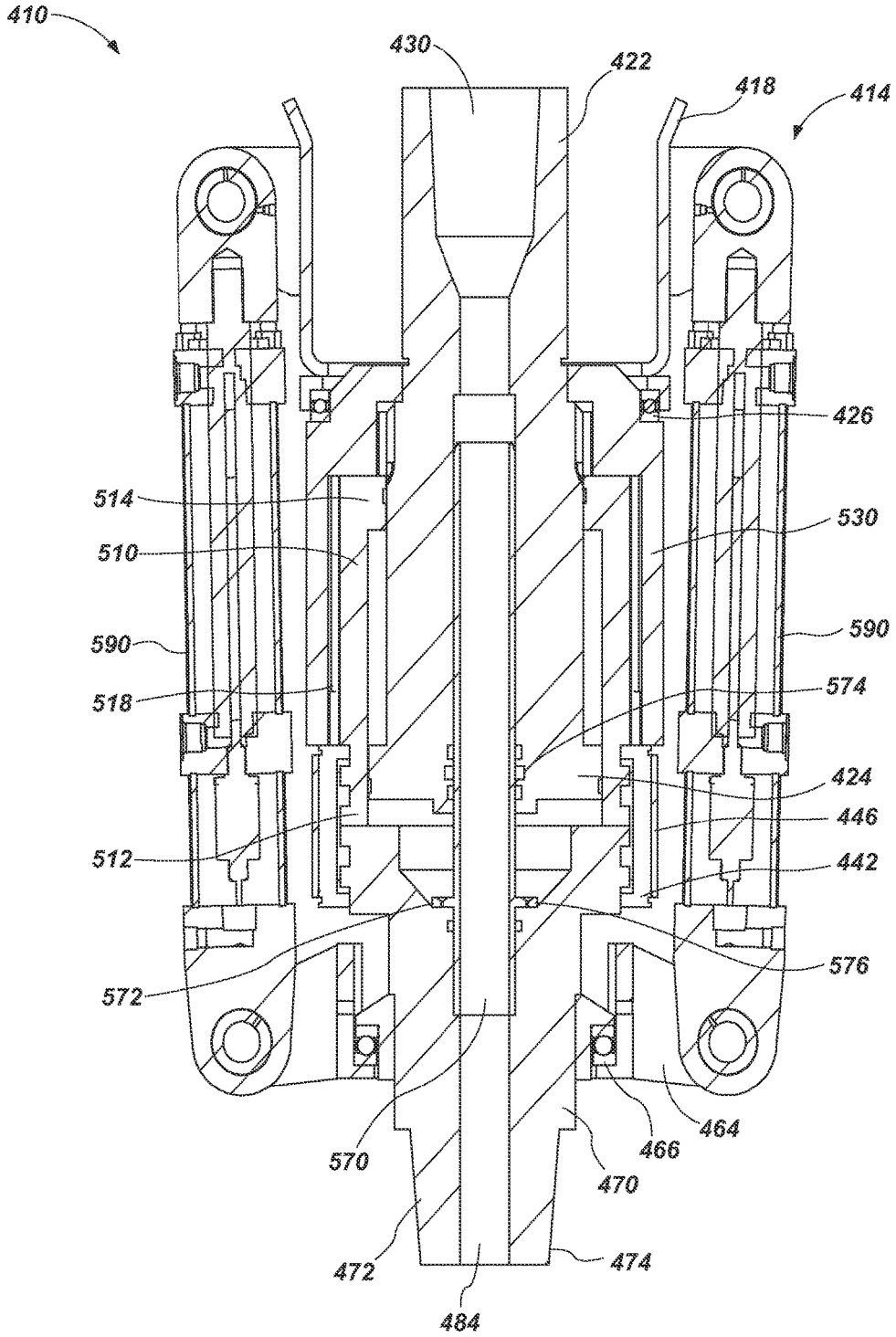
FIG. 16 illustrates a front sectional view of the thread compensation apparatus of FIGS. 14 A-B, as taken along the line A-A of FIG. 14B, and as shown in a retracted configuration.
Figure 17A:
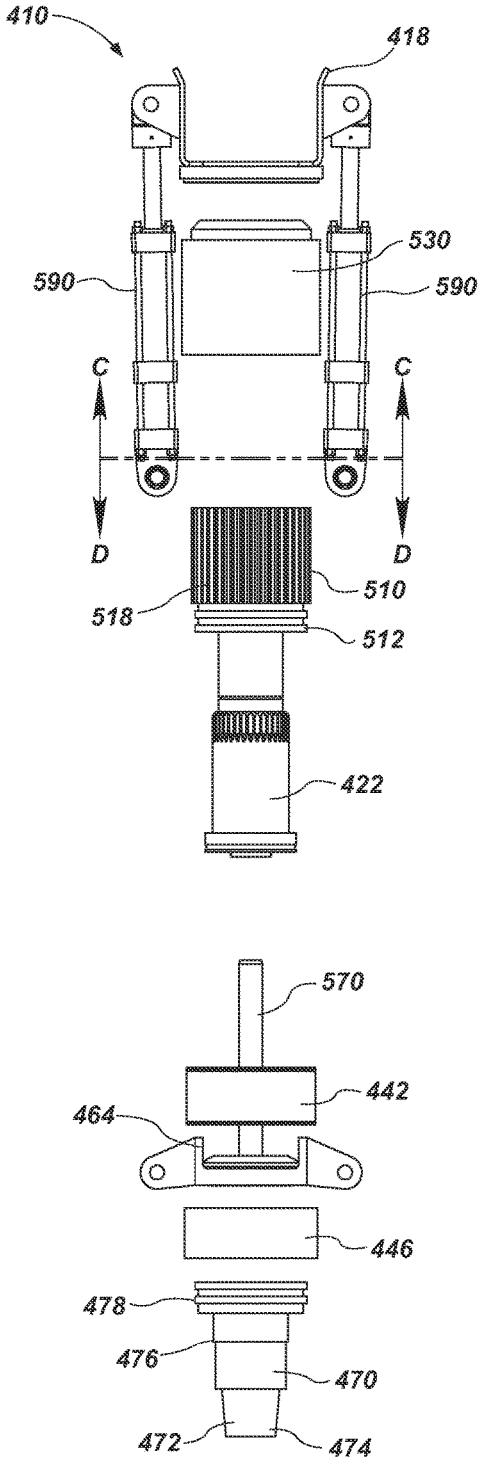
FIGS. 17A-B illustrate front and isometric exploded views, respectively, of the thread compensation apparatus of FIGS. 14 A-B.
Figure 17B:
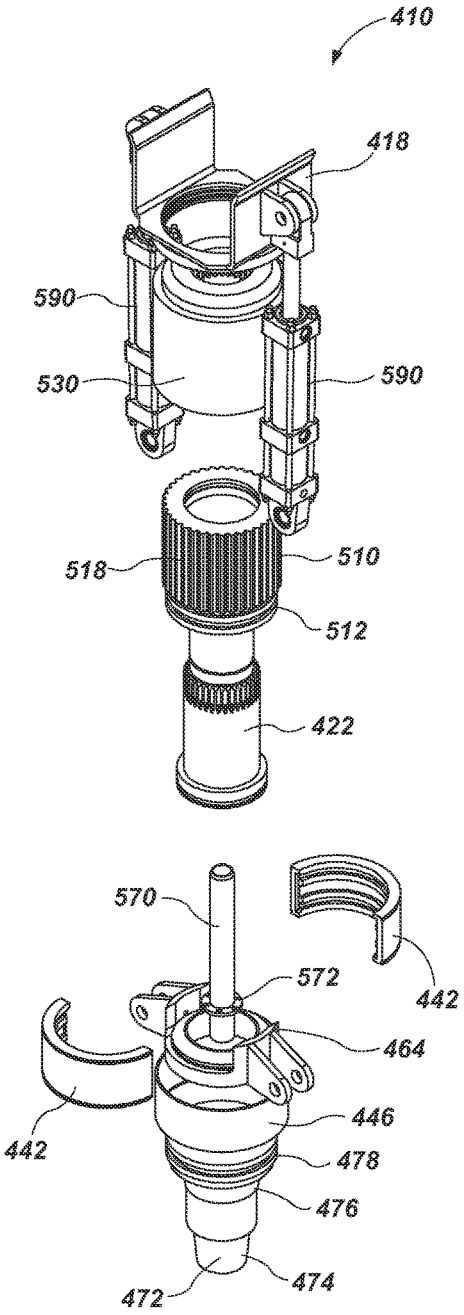

When the exterior shoulder 424 and the load shoulder 514 are seated against one another, the thread compensation apparatus 410 can be said to be in at least a partially extended position. This extended configuration is shown in FIG. 15, noting that the one or more actuators 590 are extended and the limiting system engaged with the exterior shoulder 424 and the load shoulder 514 being engaged with one another. When the one or more actuators 590 are retracted and the exterior shoulder 424 is unseated from the load shoulder 514, the thread compensation apparatus 410 can be said to be in a retracted position. The retracted position is shown in FIG. 16, noting that the one or more actuators 590 are retracted and the exterior shoulder 424 is disengaged from the load shoulder 514. This is an example of a limiting system within the thread compensation apparatus 410.

Similar to the example thread compensation apparatus discussed above and shown in FIGS. 3-13, it can also be appreciated that thread compensation apparatus 410 can further travel through and stop at various interim positions.

Figure 23:
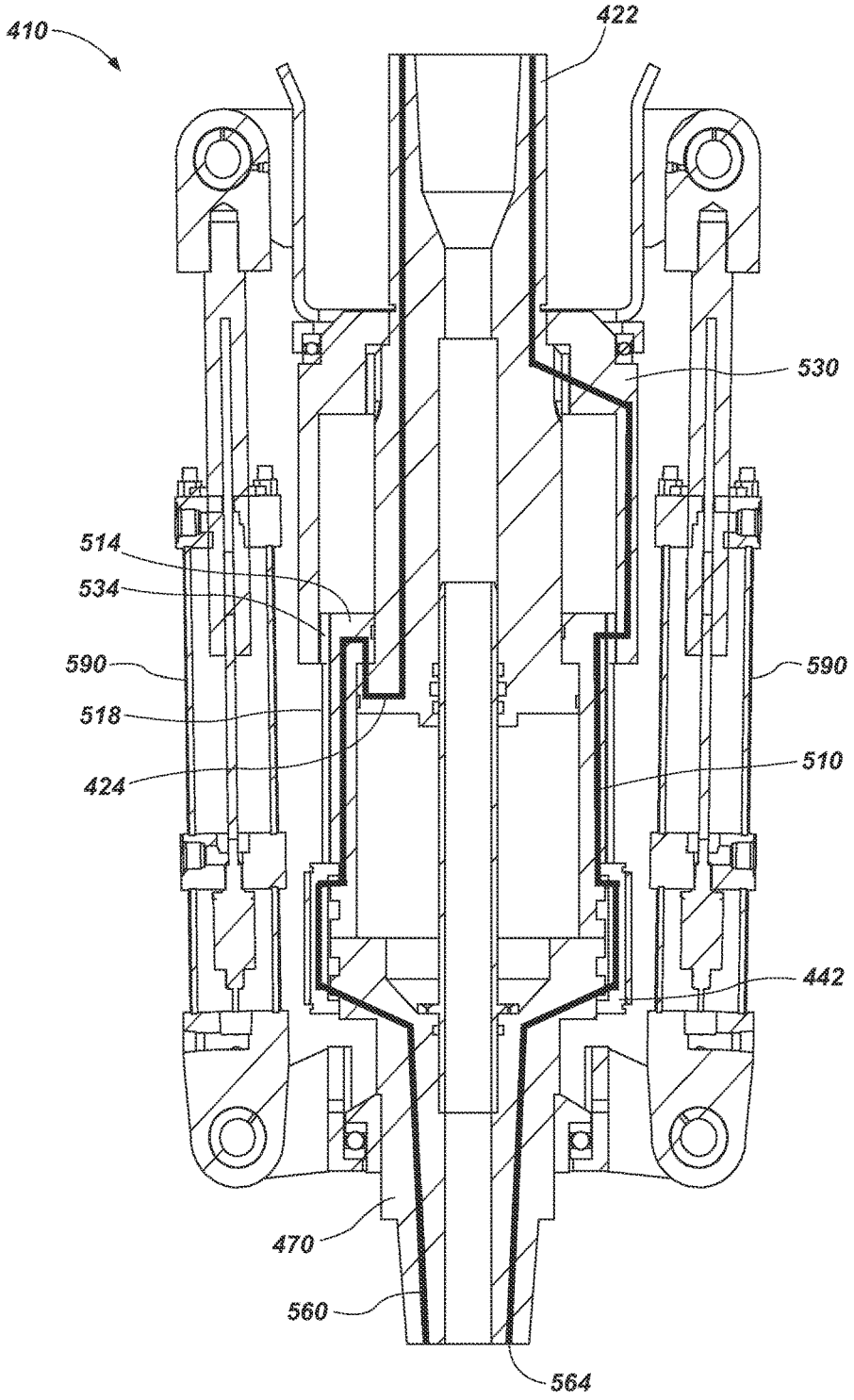
FIG. 23 illustrates a sectional view of the thread compensation apparatus of FIGS. 14 A-B further depicting both an axial load path and a torsional load path through the thread compensation apparatus.

In the extended position, as shown in FIG. 23 particularly, an axial load path, as indicated by the bold line 560, can extend from the tubular gripping apparatus (not shown), through the thread compensation apparatus 410 and on to the drive apparatus. The axial load 560 extends through the thread compensation apparatus 410 along the axial length of the lower shaft 470, through the split ring 442, along the axial length of the housing 510, through the load shoulder 514 and into the exterior shoulder 424, and along the axial length of the rotating inner portion 422 and into the drive apparatus (not shown).

A torsional load can also extend from the drive apparatus (not shown), through the thread compensation apparatus 410, to the tubular gripping apparatus (not shown), and thereby to the extending tubular. In should be appreciated that the torsional load is transferred through the thread compensation apparatus 410 in any of the retracted, extended, or interim positions. Such an exemplary torsional load path is shown generally as the bold line 564. The torsional load 564 extends through the thread compensation apparatus 410 from the drive apparatus, through a portion of the rotating inner portion 422, from the rotating inner portion 422 into the sleeve 530, through the primary splines 534, and into the secondary splines 518 and into the housing 510, along the length of the housing 510 and into the split ring 442, from the split ring 442 into the lower shaft, along the length of the lower shaft 470, into the tubular gripping apparatus (not shown), and into the extending tubular (not shown). In this manner rotation can be imparted to the extending tubular so as to thread it into the exposed end of the top tubular of the string of tubulars (not shown).

Figure 20B:
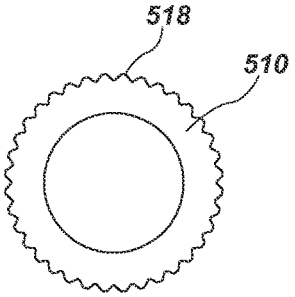
FIGS. 20 A-B illustrate front and top views, respectively, of a housing of the thread compensation apparatus of FIGS. 14 A-B.
Figure 20A:
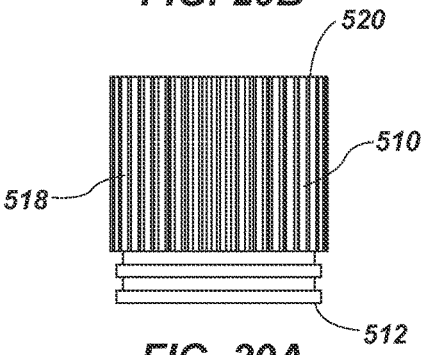

It should be appreciated that FIG. 20A depicts a side view of the housing 510. FIG. 20B depicts a top view of the housing 510 as seen from the proximal end 520 of FIG. 20A. These side and top views better depict the secondary splines 518, as well as the keyed flanges at the distal end 512 used to connect to the lower shaft via split rings (not shown).

Figure 21B:
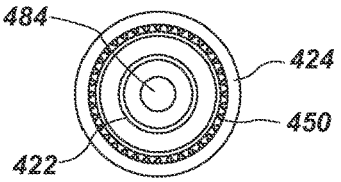
FIGS. 21 A-B illustrate front and top views, respectively, of a rotating inner portion being part of the thread compensation apparatus of FIGS. 14 A-B.
Figure 21A:
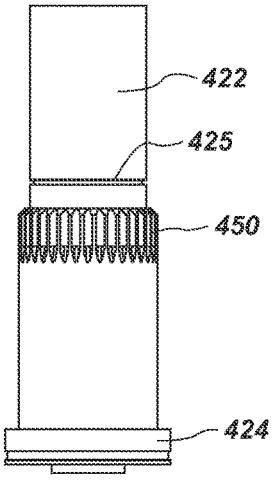
Figure 22A:
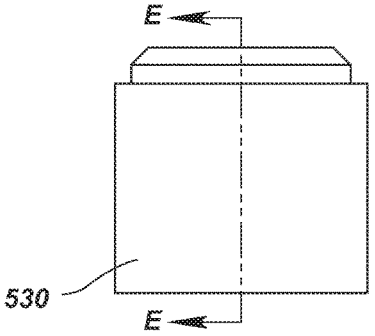
FIGS. 22 A-C illustrate front, sectional, and top views, respectively, of a sleeve being part of the thread compensation apparatus of FIGS. 14 A-B.
Figure 22B:
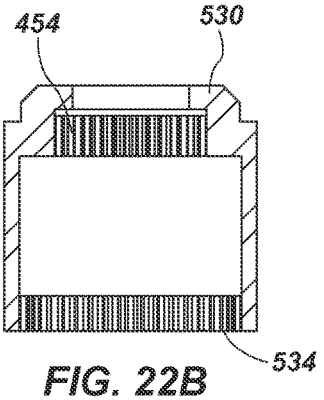
Figure 22C:
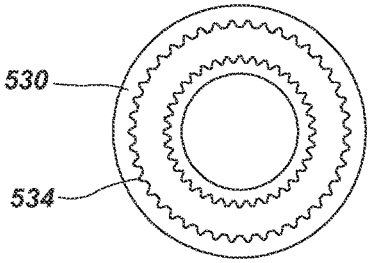

FIGS. 21A-B depict side and top views respectively of the rotating inner portion 422. These views best show the outer shoulder 424 being located at a lower end of the rotating inner portion 422. These views also show an exemplary interface between the rotating inner portion 422 and the sleeve 530 shown in FIGS. 22A-C. This interface between the rotating inner portion 422 can be provided via a plurality of primary drive splines 450 on a central portion of the rotating inner portion 422. The primary drive splines 450 can engage with, and provide rotation to, the sleeve 530 by meshing with and engaging a plurality secondary drive splines 454 provided on an interior portion of the sleeve 530. FIGS. 22B-C also show primary splines 534 on an interior surface of the sleeve 530 which engage with the secondary splines 518 of the housing 410 of FIGS. 20A-B.

The lower shaft 470 and the housing 510 are shown as separate pieces in this example, these being connected by the split ring 442. However, it will be appreciated that the lower shaft 470 and the housing 510 can also be configured as a unitary structure formed from of a single continuous piece of material. It will also be appreciated that while the primary splines 534 are located on an inner surface of the sleeve 530, the housing 510 can also be configured so as to be larger than, and encompass the sleeve 530. In such a configuration, primary splines 534 can be provided on an outer surface of the sleeve 530 and the secondary splines 528 can be provided on an inner surface of the housing 510.

Now with particular reference to FIGS. 15-17, 19, and 21A-B, shown are a plurality of channels passing through the thread compensation apparatus 410. A drive channel 430 passes through the rotating inner portion 422, and a shaft channel 484 passes through the lower shaft 470. The shaft channel 484 and the drive channel 430 are fluidly connected via a mud sleeve 570. The mud sleeve 570 is provided with a flange 572 which engages a recess 576 located within the lower shaft 470. The mud sleeve 570 extends upwards from the shaft channel 484 and slidingly engages the sidewalls of the drive channel 430. The mud sleeve 570 is sufficiently long such that the upper section never exits the drive channel 430 throughout the entire range of motion of the thread compensation apparatus 410 between fully extended and fully retracted positions. The mud sleeve 570 prevents drilling fluid, or any other fluid or gas from entering into and interfering with the axial displacement of the housing 510 with respect to the rotating inner portion 422. The drive channel 430 can also be provided with a plurality of seals 574 which prevent the pressure of the fluid within the drive channel from forcing its way between the mud sleeve 570 and the sidewalls of the drive channel 430 as the mud sleeve 570 moves therein. In essence, fluid is caused to pass through the drive channel 430, into the mud sleeve 570, and into the shaft channel 484 to provide a passageway for the fluid, and to prevent the high pressure fluid from escaping into the remaining portions of the thread compensation apparatus. Reciprocating seals 574 between the drive channel 430 and the mud sleeve 570 provide a seal that is maintained whether the thread compensation apparatus is in a retracted position, an extended position or in any position between these. Linear bearings 578 allow for smooth linear motion between the mud sleeve 570 and the drive channel 430. A static seal 580 can be located between the mud sleeve 570 and the lower shaft 470 to prevent leakage at that interface.

Disclosed is also a method of threading tubulars using a thread compensation apparatus as discussed herein. The method 800 can include coupling a thread compensation apparatus (having a drive connection interface with an outer portion and an inner rotating portion) to a drive apparatus having an outer body and a rotating drive shaft, wherein the inner rotating portion of the thread compensation apparatus is coupled to the rotating drive shaft of the drive apparatus. Further, after the thread compensation apparatus is coupled to the drive apparatus a tubular gripping apparatus can be coupled to a lower connection interface located about a distal end of a lower shaft of the thread compensation apparatus.

Once the thread compensation apparatus is coupled to both the drive apparatus and the tubular gripping apparatus, an additional step can include inserting an extending tubular into the tubular gripping apparatus. Retracting an actuator of the thread compensation apparatus so as to cause the thread compensation apparatus to be in a partially retracted position can then cause the extending tubular to float in a weightless configuration, wherein an upward force will cause the actuator to further retract, and a downward force will cause the actuator to extend.

After the actuator is almost fully retracted, the method can further comprise repositioning the drive apparatus in order to position the extending tubular in a position proximal an exposed end of a top tubular of a string of tubulars so as to position and prepare the extending tubular for the threading into the exposed end of the top tubular. In order to actually perform the threading, the drive shaft of the drive apparatus can be caused to rotate, which rotation functions to impart rotation to the inner rotating portion of the drive connection interface, which thereby imparts rotation to a sleeve and the lower shaft, wherein the lower shaft further imparts rotation to the tubular gripping apparatus and the extending tubular, thus rotating the threads of the extending tubular with respect to the threads of the exposed end of the top tubular.

As the threads engage one another, they function to pull the extending tubular in a downward direction, which causes the actuators in the thread compensation apparatus to extend and the lower shaft of the thread compensation apparatus to displace with respect to the sleeve. The rotation of the drive shaft causes a rotation of the inner rotating portion of the drive connection of the thread compensation apparatus by applying a torque with the drive apparatus, which causes the lower shaft, and thereby the extending tubular to rotate until the threads of the extending tubular and threads of the top tubular are fully engaged and the extending tubular becomes the new top tubular of the string of tubulars.

After the threads between the extending tubular and the top tubular of the string of tubulars are fully engaged, the rotation can be stopped and the new string of tubulars, including the new top tubular, can then be lifted by displacing the drive apparatus, such that the weight of the string of tubulars is supported by the drive apparatus. By lifting the string of tubulars with the drive apparatus, the floor slips, as discussed above, can be removed, the new string of tubulars can then be lowered into the drilled well. The floor slips can then be re-engaged and the process repeated until the string of tubulars reaches a desired length.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials can be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention can be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics can be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A thread compensation apparatus, comprising:

a drive connection having an outer portion configured to couple to a drive apparatus, and a rotating inner portion having a drive interface configured to couple to a rotating shaft of the drive apparatus;

a sleeve rotatable with the inner portion of the drive connection, the inner portion imparting rotation to the sleeve, and the sleeve being rotatable relative to the outer portion of the drive connection;

a lower shaft having proximal and distal ends, wherein the lower shaft engages the sleeve about the proximal end, such that the sleeve imparts rotation to the lower shaft, the lower shaft being displaceable relative to the sleeve, the lower shaft further comprising a lower connection interface about the distal end configured to couple to a tubular gripping apparatus; and an actuator coupled to the outer portion of the drive connection, wherein the actuator is operable to displace the lower shaft relative to the sleeve to compensate for tubular threading axial displacement as tubulars are connected or disconnected.

2. The thread compensation apparatus of claim 1, further comprising an annular housing fixed with respect to the sleeve, the sleeve being disposed in an interior cavity of the annular housing.

3. The thread compensation apparatus of claim 1, further comprising an annular housing displaceable with respect to the sleeve.

4. The thread compensation apparatus of claim 1, further comprising a limiting system.

5. The thread compensation apparatus of claim 4, wherein the limiting system comprises a load shoulder about an inner surface of an annular housing, the proximal end of the lower shaft further comprising a shaft shoulder operable to engage the load shoulder to limit displacement of the lower shaft.

6. The thread compensation apparatus of claim 4, wherein the limiting system comprises a load shoulder on an inner surface of an annular housing, and wherein the rotating inner portion of the drive connection extends through the sleeve and into the annular housing, the rotating inner portion of the drive connection having an exterior shoulder which engages the load shoulder of the annular housing to limit the displacement of the lower shaft.

7. The thread compensation apparatus of claim 1, further comprising a lower shaft adapter having a base portion coupled to the actuator, the lower shaft adapter facilitating rotation of the lower shaft.

8. The thread compensation apparatus of claim 7, wherein the lower shaft adapter comprises a rotating collar coupled to the lower shaft and supported about the base portion, the collar and the lower shaft being rotatable relative to the base portion of the lower shaft adapter.

9. The thread compensation apparatus of claim 8, wherein the base portion of the lower shaft adapter comprises a plurality of bearings that engage the lower shaft, and that facilitate rotation of the lower shaft relative to the base portion.

10. The thread compensation apparatus of claim 1, further comprising an adapter operable to couple the outer portion of the drive connection to the drive apparatus.

11. The thread compensation apparatus of claim 1, wherein the rotating inner portion of the drive connection further comprises a drive channel, and wherein the lower shaft further comprises a shaft channel.

12. The thread compensation apparatus of claim 11, further comprising a mud sleeve fluidly connecting and sealing the drive channel and the shaft channel, the drive channel the mud sleeve and the shaft channel defining a continuous fluid passageway through the thread compensation apparatus through which fluid can flow.

13. The thread compensation apparatus of claim 1, wherein the rotating inner portion of the drive connection comprises an upper shaft coupled to the drive apparatus via the drive interface.

14. The thread compensation apparatus of claim 13, wherein the upper shaft is coupled to the sleeve.

15. The thread compensation apparatus of claim 14, wherein the upper shaft is slidably coupled to an annular housing.

16. The thread compensation apparatus of claim 1, further comprising a control system operable to facilitate control of various functions of the thread compensation apparatus.

17. The thread compensation apparatus of claim 16, wherein the control system is configured to facilitate application of a predetermined force to the actuators, to support a weight of an extending tubular as tubulars are connected or disconnected.

18. The thread compensation apparatus of claim 16, wherein the control system is configured to facilitate retraction of the actuator to a predetermined position.

19. The thread compensation apparatus of claim 16, further comprising one or more sensors operable to sense an operating characteristic of the thread compensation apparatus, wherein the sensors are in communication and operable with the control system.

20. A tubular threading system, comprising:

a drive apparatus having a rotating shaft;

a thread compensation apparatus comprising:

a drive connection having an outer portion coupled to the drive apparatus, and a rotating inner portion coupled to the rotating shaft of the drive apparatus;

a sleeve rotatable with the inner portion of the drive connection, the inner portion imparting rotation to the sleeve, and the sleeve being rotatable relative to the outer portion of the drive connection;

a lower shaft having proximal and distal ends, wherein the lower shaft engages the sleeve about the proximal end, such that the sleeve imparts rotation to the lower shaft, the lower shaft being displaceable relative to the sleeve, the lower shaft further comprising a lower connection interface about the distal end; and an actuator coupled to the outer portion of the drive connection, wherein the actuator is operable to displace the lower shaft relative to the sleeve to compensate for tubular threading axial displacement as tubulars are connected or disconnected;

a tubular gripping apparatus holding a connecting tubular at a second end; and a string of tubulars having a top tubular, the top tubular having an exposed end.

21. The system of claim 20, wherein the thread compensation apparatus comprises a first retracted position, wherein the lower shaft, the tubular gripping apparatus, and the connecting tubular are lifted, such that these are caused to be suspended about the exposed end of the top tubular of the & string of tubulars.

22. The system of claim 21, wherein the drive apparatus imparts rotation via the thread compensation apparatus to the connecting tubular and the thread compensation apparatus is caused to move from the first retracted position to a second interim position, wherein the lower shaft, the tubular gripping apparatus, and the connecting tubular are lowered to facilitate threading of the connecting tubular to the top tubular.

23. The system of claim 20, wherein the thread compensation apparatus further comprises a third extended position, wherein displacement of the lower shaft is limited by a limiting system.

24. The system of claim 23, wherein the limiting system comprises a load shoulder about an inner surface of an annular housing, the proximal end of the lower shaft further comprising a shaft shoulder operable to engage the load shoulder to limit displacement of the lower shaft.

25. The system of claim 23, wherein the limiting system comprises a load shoulder on an inner surface of an annular housing, and wherein the rotating inner portion of the drive connection extends though the sleeve and into the annular housing, the rotating inner portion of the drive connection having an exterior shoulder which engages the load shoulder of the annular housing to limit the displacement of the lower shaft.

26. The system of claim 20, wherein an axial load path through the thread compensation apparatus extends through the rotating inner portion of the drive connection, through an annular housing, and through the lower shaft.

27. The system of claim 20, wherein a torsional load path through the thread compensation apparatus extends through the rotating inner portion of the drive connection, through the sleeve, and through the lower shaft, wherein the rotating shaft applies a torque to the rotating inner portion.

28. The system of claim 20, wherein a torsional load path through the thread compensation apparatus extends through the rotating inner portion of the drive connection, through the sleeve, through an annular housing, and through the lower shaft, wherein the rotating shaft applies a torque to the rotating inner portion.

29. The system of claim 20, further comprising an annular housing fixed with respect to the sleeve, the sleeve being disposed in an interior cavity of the annular housing.

30. The system of claim 20, further comprising an annular housing displaceable with respect to the sleeve.

31. The system of claim 20, wherein the rotating inner portion of the drive connection further comprises a drive channel, and wherein the lower shaft further comprises a shaft channel.

32. The system of claim 31, further comprising a mud sleeve fluidly connecting and sealing the drive channel and the shaft channel, the drive channel the mud sleeve and the shaft channel defining a continuous fluid passageway through the thread compensation apparatus through which fluid can flow.

33. The system of claim 20, wherein the sleeve comprises a plurality of primary splines about an outer surface, and wherein the lower shaft has a plurality of secondary splines located about a portion of an inner surface which engage the primary splines of the sleeve.

34. The system of claim 20, wherein the sleeve comprises a plurality of primary splines about an inner surface, and wherein the thread compensation apparatus further comprises a housing having a plurality of secondary splines located about an outer surface which engage the primary splines of the sleeve, the lower shaft being coupled to the housing.

35. The system of claim 20, wherein the lower shaft further comprises an adapter operable to couple to the outer portion of the drive connection, the adapter including bearings which facilitate rotation of the lower shaft and wherein the adapter guides the lower shaft to move coaxially with respect to the sleeve.

36. The system of claim 20, further comprising a control system operable with one or more sensors operable with the thread compensation apparatus, to facilitate control of various functions of the thread compensation apparatus.

37. A method of threading tubulars, comprising:

coupling a thread compensation apparatus having a drive connection interface with an outer portion and an inner rotating portion to a drive apparatus having an outer body and a rotating drive shaft, wherein the inner rotating portion is coupled to the rotating drive shaft;

coupling a tubular gripping apparatus to the thread compensation apparatus;

inserting an extending tubular into the tubular gripping apparatus, wherein the tubular gripping apparatus grips the extending tubular;

retracting an actuator of the thread compensation apparatus so as to cause the thread compensation apparatus to be in a first retracted position;

repositioning the drive apparatus in order to position the extending tubular such that an end of the extending tubular is proximal an exposed end of a top tubular of a string of tubulars;

rotating the drive shaft of the drive apparatus which imparts rotation to the inner rotating portion of the drive connection interface which thereby imparts rotation to a sleeve and the lower shaft, wherein the lower shaft further imparts rotation to the tubular gripping apparatus and the extending tubular;

threading the extending tubular to the top tubular, wherein the actuator is caused to extend to displace the lower shaft relative to the sleeve to compensate for threading displacement as the extending tubular is threaded to the top tubular; and displacing the drive apparatus such that the weight of the string of tubulars is supported by the drive apparatus.

38. The method of claim 37, wherein displacing the drive apparatus causes the weight of the string of tubulars to be transferred to the drive apparatus through a limiting system of the thread compensation apparatus.

39. The method of claim 38, wherein an axial load path of the weight of the string of tubulars extends through the thread compensation apparatus by extending through the rotating inner portion of the drive connection, through a housing, and through the lower shaft.

40. The method of claim 37, wherein a torsional load path through the thread compensation apparatus extends through the rotating inner portion of the drive connection, through the sleeve, and through the lower shaft, wherein the rotating shaft applies a torque to the rotating inner portion.

41. The method of claim 37, wherein a torsional load path through the thread compensation apparatus extends through the rotating inner portion of the drive connection, through the sleeve, through a housing, and through the lower shaft, wherein the rotating shaft applies a torque to the rotating inner portion.

* * * * *